US011589653B2

(12) United States Patent
Hopkins

(10) Patent No.: US 11,589,653 B2
(45) Date of Patent: Feb. 28, 2023

(54) TENSION-RETAINING SYSTEM FOR A WEARABLE ARTICLE

(71) Applicant: NIKE, Inc., Beaverton, OR (US)

(72) Inventor: Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 218 days.

(21) Appl. No.: 17/063,960

(22) Filed: Oct. 6, 2020

(65) Prior Publication Data

US 2021/0153605 A1 May 27, 2021

Related U.S. Application Data

(60) Provisional application No. 62/939,732, filed on Nov. 25, 2019.

(51) Int. Cl.
*A43C 11/00* (2006.01)

(52) U.S. Cl.
CPC ..... *A43C 11/008* (2013.01)

(58) Field of Classification Search
CPC . A43C 11/008; A43C 11/004; A43C 11/1493; A43C 1/06; A43C 7/00; A43C 11/1406; A43B 11/00; Y10T 24/2183
See application file for complete search history.

(56) References Cited

U.S. PATENT DOCUMENTS

| | | | |
|---|---|---|---|
| 4,497 | A | 5/1846 | Vetter |
| 75,048 | A | 3/1868 | Perley |
| 171,301 | A | 12/1875 | McKee |
| 417,460 | A | 12/1889 | Wurtele |
| 474,574 | A | 5/1892 | Bruzon |
| 503,588 | A | 8/1893 | Elterich et al. |
| 537,627 | A | 4/1895 | Bixby et al. |
| 558,937 | A | 4/1896 | Edmonds |
| 808,948 | A | 1/1906 | Roberts |
| 827,330 | A | 7/1906 | Tillson |
| 863,549 | A | 8/1907 | Metz |
| 955,337 | A | 4/1910 | Lawlor |
| 1,081,678 | A | 12/1913 | Langerak |

(Continued)

FOREIGN PATENT DOCUMENTS

| | | | |
|---|---|---|---|
| CN | 87209219 | U | 5/1988 |
| CN | 87103983 | A | 12/1988 |

(Continued)

OTHER PUBLICATIONS

Kizik Design, Kizik® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

(Continued)

*Primary Examiner* — Robert Sandy
*Assistant Examiner* — Rowland Do
(74) *Attorney, Agent, or Firm* — Quinn IP Law

(57) ABSTRACT

A tension-retaining system for retaining tension in a tensioning cord of a wearable article may include a retainer including an anchor and a wedge. The anchor may define a notch, and the wedge may have a tensioning cord coupling feature. The wedge may have an engagement portion that fits within the notch with the engagement portion disposed further in the notch than the tensioning cord coupling feature.

20 Claims, 17 Drawing Sheets

(56) References Cited

U.S. PATENT DOCUMENTS 1,494,236 A 5/1924 Greathouse
1,585,049 A 5/1926 Skoglund
1,603,144 A 10/1926 Nichols
1,686,175 A 10/1928 Read
1,812,622 A 6/1931 Costello
2,069,752 A 2/1937 Dorr
2,252,315 A 8/1941 Doree
2,302,596 A 11/1942 Bigio
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,283,423 A 11/1966 Schovee
3,349,505 A 10/1967 Lopez
3,400,474 A 9/1968 Tendler
3,436,842 A 4/1969 Sachs
3,681,860 A 8/1972 Bidegain
4,095,356 A 6/1978 Robran et al.
4,136,468 A 1/1979 Munschy
4,288,891 A 9/1981 Boden
4,309,832 A 1/1982 Hunt
4,489,509 A 12/1984 Libit
4,507,879 A 4/1985 Dassler
4,559,724 A 12/1985 Norton
4,562,651 A 1/1986 Frederick et al.
4,573,457 A 3/1986 Parks
4,594,798 A 6/1986 Autry et al.
4,599,811 A 7/1986 Rousseau
4,615,126 A 10/1986 Mathews
4,649,656 A 3/1987 Cox et al.
4,665,634 A 5/1987 Diaz
4,776,111 A 10/1988 Crowley
4,944,099 A 7/1990 Davis
4,959,914 A 10/1990 Hilgarth
4,972,613 A 11/1990 Loveder
5,054,216 A 10/1991 Lin
5,060,401 A 10/1991 Whatley
5,090,140 A 2/1992 Sessa
5,127,170 A 7/1992 Messina
5,152,082 A 10/1992 Culpepper
5,158,428 A 10/1992 Gessner et al.
5,181,331 A 1/1993 Berger
D333,377 S 2/1993 Hatfield
5,184,410 A 2/1993 Hamilton
5,222,313 A 6/1993 Dowdy et al.
5,279,051 A 1/1994 Whatley
5,282,327 A 2/1994 Ogle
5,341,583 A 8/1994 Hallenbeck
5,345,698 A 9/1994 Billet et al.
5,353,483 A * 10/1994 Louviere ..... A43C 11/1493 24/712.1
5,371,957 A 12/1994 Gaudio
5,467,537 A 11/1995 Aveni et al.
5,469,640 A * 11/1995 Nichols ..... A43C 1/00 24/712.1
5,471,769 A * 12/1995 Sink ..... A43B 11/00 24/712.1
5,481,814 A 1/1996 Spencer
5,537,763 A 7/1996 Donnadieu et al.
5,557,866 A 9/1996 Prengler
5,570,523 A 11/1996 Lin
5,682,687 A 11/1997 Arai
5,813,144 A 9/1998 Prengler
5,839,210 A * 11/1998 Bernier ..... A43B 3/0078 36/138
5,842,292 A 12/1998 Siesel
5,848,457 A 12/1998 Silagy
5,884,420 A 3/1999 Donnadieu
5,983,530 A 11/1999 Chou
5,997,027 A 12/1999 Jungkind
6,000,148 A 12/1999 Cretinon
6,185,798 B1 2/2001 Ton
6,189,239 B1 2/2001 Gasparovic et al.
6,290,559 B1 9/2001 Scott
6,298,582 B1 10/2001 Friton et al.
6,327,750 B1 * 12/2001 Muldowney ..... A43C 1/00 24/712.1
6,334,240 B1 1/2002 Li
6,378,230 B1 4/2002 Rotem et al.
6,381,816 B1 5/2002 Lai et al.
6,438,872 B1 8/2002 Chil et al.
6,557,271 B1 5/2003 Weaver, III
6,568,104 B2 5/2003 Liu
6,578,288 B2 6/2003 Bernstein
6,594,921 B2 7/2003 Laio et al.
6,643,954 B2 11/2003 Voswinkel
6,662,415 B1 12/2003 Lin
6,684,533 B1 2/2004 Su
6,718,658 B2 4/2004 Karasawa
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
6,964,119 B2 11/2005 Weaver, III
D521,854 S 5/2006 Wolfberg
7,055,268 B2 6/2006 Ha
7,059,069 B2 6/2006 Raluy et al.
7,080,468 B2 7/2006 Miller et al.
7,101,604 B1 9/2006 Minges
7,103,994 B2 9/2006 Johnson
7,127,837 B2 10/2006 Ito
7,178,270 B2 2/2007 Hurd et al.
7,188,438 B1 3/2007 Bowen
7,225,563 B2 6/2007 Chen et al.
7,243,399 B2 7/2007 Liao
7,284,341 B2 10/2007 Moseley
7,287,294 B2 10/2007 Miller et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,818,899 B2 10/2010 Dinndorf et al.
7,823,299 B1 11/2010 Brigham
7,856,740 B2 * 12/2010 De Bast ..... A43B 5/14 24/593.11
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
7,984,571 B2 7/2011 Pellegrini
8,006,410 B2 8/2011 Romboli et al.
8,020,317 B1 9/2011 Sokolowski
D648,512 S 11/2011 Schlageter et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,365,443 B2 2/2013 Huynh
D680,719 S 4/2013 Dardinski
8,468,721 B2 6/2013 Sokolowski
8,468,723 B2 6/2013 Malka-Harari

(56) References Cited

U.S. PATENT DOCUMENTS 8,499,474 B2 8/2013 Kaufman
8,539,698 B1 9/2013 Woodruff
8,549,774 B2 10/2013 Meschter et al.
8,627,582 B2 1/2014 Perenich
8,627,583 B2 1/2014 Perenich
8,635,791 B2 1/2014 Baudouin et al.
8,656,613 B2 2/2014 Stockbridge et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,044,063 B2 6/2015 Loverin et al.
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,241,748 B2 1/2016 Bernstein et al.
9,254,018 B2 2/2016 Bliss
9,265,305 B2 2/2016 Hatfield et al.
9,301,570 B2 4/2016 Hwang
9,314,055 B2 4/2016 Moran
9,314,067 B2 4/2016 Bock
D758,836 S 6/2016 Symons
D758,837 S 6/2016 Symons
9,363,980 B2 6/2016 Lander
9,392,843 B2 7/2016 Callahan et al.
9,392,844 B1 7/2016 Burrell
9,398,785 B2 7/2016 Horacek
9,398,786 B2 7/2016 Gavrieli et al.
9,414,640 B2 8/2016 Nichols
9,433,256 B2 9/2016 Callahan et al.
9,445,644 B2 9/2016 Cressman et al.
9,474,330 B2 10/2016 Panian et al.
9,480,299 B2 11/2016 Dinndorf et al.
D776,420 S 1/2017 Petrie
9,675,132 B2 6/2017 Marshall
9,820,527 B2 11/2017 Pratt et al.
9,839,261 B2 12/2017 Hatfield et al.
9,854,875 B2 1/2018 Hatfield et al.
9,877,542 B2 1/2018 Pratt
9,936,767 B2 4/2018 Theuvenet et al.
9,949,533 B2 4/2018 Feinstein
10,021,944 B2 7/2018 Kawaguchi
10,070,694 B2 9/2018 Schreiner
10,159,310 B2 12/2018 Sullivan
10,660,401 B1 5/2020 Pratt et al.
10,779,607 B1 9/2020 Chandel
11,000,091 B1 5/2021 Kyle
2002/0095823 A1* 7/2002 Laio ..... A43B 3/242 36/105
2002/0144434 A1 10/2002 Farys et al.
2002/0174568 A1 11/2002 Neiley
2003/0177661 A1 9/2003 Tsai
2003/0200680 A1 10/2003 Chang
2004/0111921 A1 6/2004 Lenormand
2005/0039348 A1 2/2005 Raluy et al.
2005/0060913 A1 3/2005 Chil et al.
2005/0066548 A1 3/2005 Chil et al.
2007/0011917 A1 1/2007 Hayes
2007/0039208 A1 2/2007 Bove et al.
2007/0074425 A1 4/2007 Leong
2007/0186441 A1 8/2007 Chen
2007/0199211 A1 8/2007 Campbell
2007/0199213 A1 8/2007 Campbell et al.
2007/0209234 A1 9/2007 Chou
2008/0000106 A1 1/2008 Culpepper
2008/0086911 A1 4/2008 Labbe
2008/0115334 A1 5/2008 Chen et al.
2008/0141562 A1 6/2008 Peveto
2008/0168683 A1 7/2008 Keating
2008/0307673 A1 12/2008 Johnson
2009/0025260 A1 1/2009 Nakano
2010/0115744 A1 5/2010 Fong
2010/0251572 A1 10/2010 Baudouin et al.
2010/0319216 A1 12/2010 Grenzke et al.
2011/0016751 A1 1/2011 Somerville
2011/0146106 A1 6/2011 Kaufman
2011/0247238 A1 10/2011 Chestnut
2012/0079746 A1 4/2012 Ferreira et al.
2012/0204450 A1 8/2012 Girbaud
2012/0317839 A1 12/2012 Pratt
2013/0104346 A1 5/2013 Kawaguchi
2013/0185959 A1 7/2013 Coleman
2013/0219747 A1 8/2013 Lederer
2014/0000131 A1 1/2014 Meschter et al.
2014/0013624 A1 1/2014 Stockbridge et al.
2014/0096415 A1 4/2014 Long
2014/0115925 A1 5/2014 Hurd et al.
2014/0250723 A1 9/2014 Kohatsu
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2015/0020416 A1 1/2015 Wiens
2015/0047223 A1 2/2015 Flinterman et al.
2015/0047227 A1 2/2015 Fallon et al.
2015/0096197 A1 4/2015 Salinas
2015/0113834 A1 4/2015 Dojan et al.
2015/0143720 A1 5/2015 Avar
2015/0196095 A1 7/2015 Chapman
2015/0216252 A1 8/2015 Wiens
2015/0289595 A1 10/2015 Rushbrook et al.
2015/0305432 A1 10/2015 Wiens
2015/0305442 A1 10/2015 Ravindran
2015/0374065 A1 12/2015 DiFrancisco
2016/0108989 A1 4/2016 Symons
2016/0128429 A1 5/2016 Hatfield et al.
2016/0166006 A1 6/2016 DiFrancisco
2016/0242493 A1 8/2016 Stillwagon
2016/0286900 A1 10/2016 Parker
2016/0374427 A1 12/2016 Zahabian
2017/0042290 A1 2/2017 Hatfield et al.
2017/0049190 A1 2/2017 Maussen
2017/0099906 A1 4/2017 Figueroa
2017/0360143 A1 12/2017 Pratt et al.
2018/0110287 A1 4/2018 Hopkins et al.
2018/0110288 A1 4/2018 Hatfield et al.
2018/0110289 A1 4/2018 Owings et al.
2018/0110292 A1 4/2018 Beers et al.
2018/0110295 A1 4/2018 Dyer et al.
2018/0206588 A1 7/2018 Pratt et al.
2018/0213882 A1 8/2018 Morse
2018/0213890 A1 8/2018 Innocente
2018/0235314 A1 8/2018 Farage
2018/0255878 A1 9/2018 Harris
2018/0263332 A1 9/2018 Bruno
2018/0295942 A1 10/2018 Drake
2019/0000180 A1 1/2019 Moriyasu et al.

FOREIGN PATENT DOCUMENTS

CN 2052208 U 2/1990
CN 2161101 Y 4/1994
CN 2262929 Y 9/1997
CN 2268406 Y 11/1997
CN 2275814 Y 3/1998
CN 2281094 Y 5/1998
CN 2384464 Y 6/2000
CN 2438353 Y 7/2001
CN 2456500 Y 10/2001
CN 2482829 Y 3/2002
CN 1403041 A 3/2003
CN 1565297 A 1/2005
CN 2712118 Y 7/2005
CN 1720835 A 1/2006
CN 2783792 Y 5/2006

(56) References Cited

FOREIGN PATENT DOCUMENTS

| | | | |
|---|---|---|---|
| CN | 2819852 | Y | 9/2006 |
| CN | 1278639 | C | 10/2006 |
| CN | 1943463 | A | 4/2007 |
| CN | 2901950 | Y | 5/2007 |
| CN | 201005111 | Y | 1/2008 |
| CN | 201157014 | Y | 12/2008 |
| CN | 201167619 | Y | 12/2008 |
| CN | 101485505 | A | 7/2009 |
| CN | 101518380 | A | 9/2009 |
| CN | 201426430 | Y | 3/2010 |
| CN | 201504620 | U | 6/2010 |
| CN | 101500446 | B | 1/2011 |
| CN | 201743039 | U | 2/2011 |
| CN | 101986920 | A | 3/2011 |
| CN | 201831038 | U | 5/2011 |
| CN | 102159288 | A | 8/2011 |
| CN | 201967803 | U | 9/2011 |
| CN | 102256673 | A | 11/2011 |
| CN | 202211219 | U | 5/2012 |
| CN | 101991227 | B | 8/2012 |
| CN | 202819794 | U | 3/2013 |
| CN | 203121188 | U | 8/2013 |
| CN | 203137220 | U | 8/2013 |
| CN | 203841187 | U | 9/2014 |
| CN | 203884822 | U | 10/2014 |
| CN | 203913577 | U | 11/2014 |
| CN | 204070772 | U | 1/2015 |
| CN | 104394729 | A | 3/2015 |
| CN | 102595952 | B | 4/2015 |
| CN | 205040743 | U | 2/2016 |
| CN | 105876979 | A | 8/2016 |
| CN | 205568021 | U | 9/2016 |
| CN | 205658453 | U | 10/2016 |
| CN | 205671573 | U | 11/2016 |
| CN | 205795015 | U | 12/2016 |
| CN | 206025369 | U | 3/2017 |
| CN | 107692396 | A | 2/2018 |
| CN | 107921318 | A | 4/2018 |
| CN | 207544444 | U | 6/2018 |
| CN | 207949063 | U | 10/2018 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 29723911 | U1 | 5/1999 |
| DE | 10247163 | A1 | 4/2004 |
| DE | 102004005288 | A1 | 8/2005 |
| DE | 102009023689 | A1 | 12/2010 |
| DE | 102013200701 | A1 | 7/2013 |
| DE | 202016001813 | U1 | 6/2017 |
| EP | 0079874 | A1 | 5/1983 |
| EP | 0570621 | A1 | 11/1993 |
| EP | 0548116 | B1 | 12/1994 |
| EP | 0848917 | A1 | 6/1998 |
| EP | 1059044 | A1 | 12/2000 |
| EP | 1440627 | A1 | 7/2004 |
| EP | 1593315 | B1 | 5/2008 |
| EP | 1952715 | A1 | 8/2008 |
| EP | 2173208 | B1 | 12/2010 |
| EP | 2277402 | A2 | 1/2011 |
| EP | 2490565 | A1 | 8/2012 |
| EP | 2036449 | B1 | 4/2013 |
| EP | 2604136 | A1 | 6/2013 |
| EP | 2606760 | A1 | 6/2013 |
| EP | 2818068 | A1 | 12/2014 |
| EP | 2848141 | A1 | 3/2015 |
| EP | 2937007 | A1 | 10/2015 |
| FR | 2689732 | A3 | 10/1993 |
| FR | 2847129 | A1 | 5/2004 |
| FR | 2994800 | A1 | 3/2014 |
| GB | 1154145 | A | 6/1969 |
| GB | 1358470 | A | 7/1974 |
| GB | 2517399 | A | 2/2015 |
| GB | 2533809 | A | 7/2016 |
| JP | H0181910 | U | 6/1989 |
| JP | 2001149394 | A | 6/2001 |
| JP | 2004236860 | A | 8/2004 |
| JP | 2006055571 | A | 3/2006 |
| JP | 2008206629 | A | 9/2008 |
| JP | 2014176633 | A | 9/2014 |
| KR | 20090130804 | A | 12/2009 |
| KR | 20130119566 | A | 11/2013 |
| NL | 1020208 | C1 | 9/2003 |
| TW | 585748 | B | 5/2004 |
| TW | M275736 | U | 9/2005 |
| TW | 200930315 | A | 7/2009 |
| TW | 201130440 | A | 9/2011 |
| TW | M449484 | U | 4/2013 |
| TW | M469778 | U | 1/2014 |
| TW | I581730 | B | 5/2017 |
| WO | 8808678 | A1 | 11/1988 |
| WO | 9737556 | A1 | 10/1997 |
| WO | 0076337 | A1 | 12/2000 |
| WO | 03039283 | A1 | 5/2003 |
| WO | 2005070246 | A2 | 8/2005 |
| WO | 2006084185 | A1 | 8/2006 |
| WO | 2006138170 | A1 | 12/2006 |
| WO | 2007024875 | A2 | 3/2007 |
| WO | 2007080205 | A1 | 7/2007 |
| WO | 2008115743 | A1 | 9/2008 |
| WO | 2008152414 | A1 | 12/2008 |
| WO | 2009154350 | A1 | 12/2009 |
| WO | 2010048203 | A1 | 4/2010 |
| WO | 2010059716 | A2 | 5/2010 |
| WO | 2010114993 | A1 | 10/2010 |
| WO | 2011004946 | A1 | 1/2011 |
| WO | 2011140584 | A1 | 11/2011 |
| WO | 2012044974 | A1 | 4/2012 |
| WO | 2012168956 | A1 | 12/2012 |
| WO | 2013039385 | A1 | 3/2013 |
| WO | 2013187288 | A1 | 12/2013 |
| WO | 2014033396 | A1 | 3/2014 |
| WO | 2014038937 | A1 | 3/2014 |
| WO | 2014140443 | A1 | 9/2014 |
| WO | 2015002521 | A1 | 1/2015 |
| WO | 2015198460 | A1 | 12/2015 |
| WO | 2016005696 | A1 | 1/2016 |
| WO | 2018092023 | A1 | 5/2018 |
| WO | 2018193276 | A1 | 10/2018 |

OTHER PUBLICATIONS

Aidin H., Under Armour's Innovative Fall/Winter2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).

Kizik Design, Kizik® Shoes Launch Footwear Revolution with Patented Handsfree Technology, https://www.prnewswire.com/news-releases/kizik-shoes-launch-footwear-revolution-with-patented-handsfree-echnology-300594838.html, Feb. 7, 2018.

Nike Ease Challenge Winner Announced, Nike News, Apr. 25, 2017, https://news.nike.com/news/nike-ease-challenge-dinner-announced (accessed May 2, 2018).

U.S. Appl. No. 61/260,621, filed Nov. 12, 2009.

U.S. Appl. No. 62/326,650, filed Apr. 22, 2016.

U.S. Appl. No. 62/368,497, filed Jul. 29, 2016.

U.S. Appl. No. 62/486,311, filed Apr. 17, 2017.

* cited by examiner

TENSION-RETAINING SYSTEM FOR A WEARABLE ARTICLE

CROSS-REFERENCE TO RELATED APPLICATIONS

This application claims priority to, and the benefit of, U.S. Provisional Application No. 62/939,732, filed Nov. 25, 2019, which is hereby incorporated by reference in its entirety.

TECHNICAL FIELD

The present disclosure generally relates to a tension-retaining system for retaining tension in a tensioning cord of a closure system of a wearable article, and to a wearable article having the tensioning-retaining system, such as an article of footwear.

BACKGROUND

Wearable articles such as footwear, garments, headwear, other apparel, and carry bags may include a closure system that adjusts the fit of the wearable article to the body. For example, a closure system for an article of footwear may include a tensioning cord to tighten an upper around a foot.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
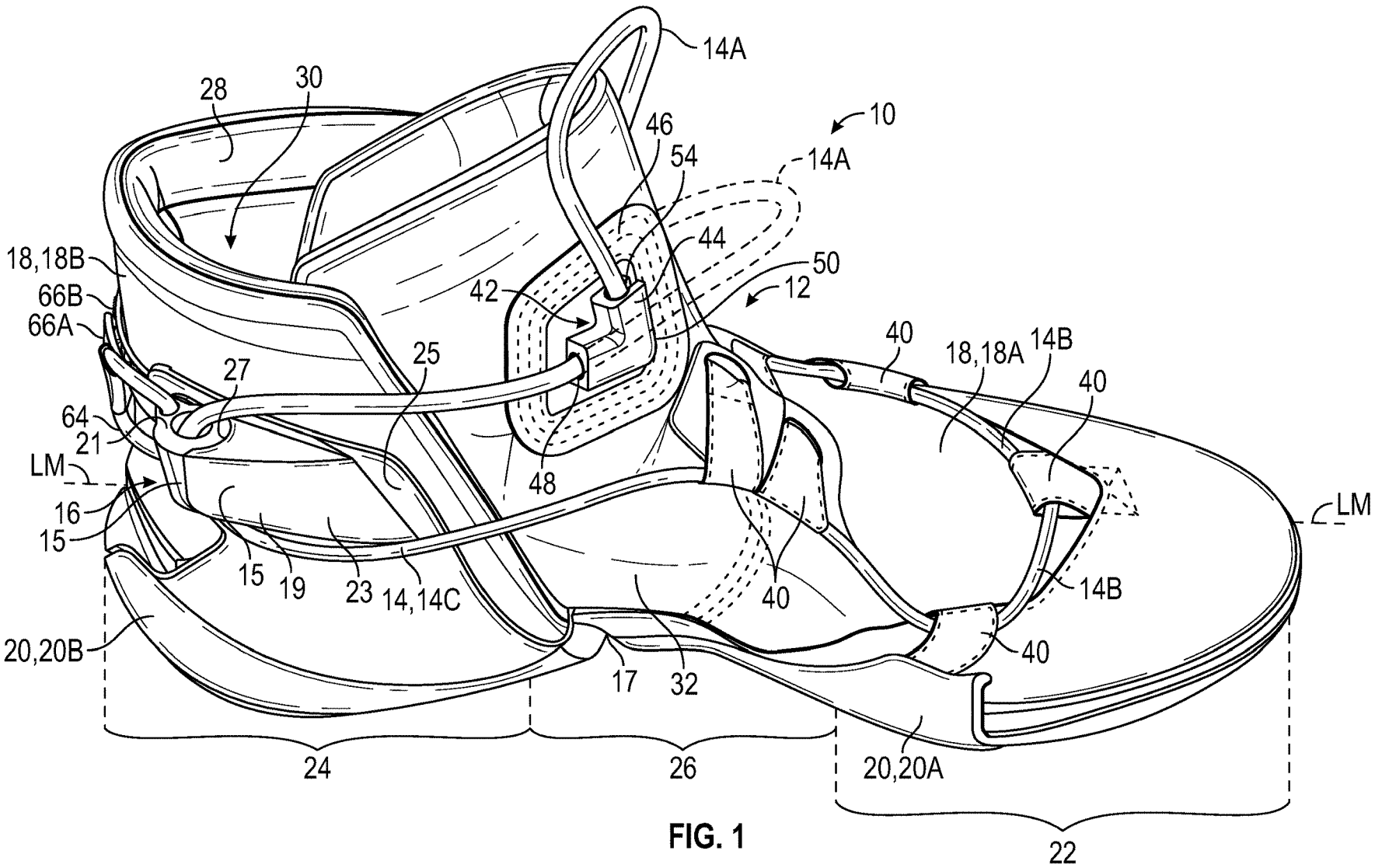
FIG. 1 is a perspective view of a medial side of an article of footwear having a closure system with a tensioning cord and a tension-retaining system for the tensioning cord.

A tension-retaining system for retaining tension in a tensioning cord of a closure system of a wearable article enables quick and secure engagement to retain tension in the tensioning cord. Additionally, the tension-retaining system may be configured to automatically center a wedge to an anchor of the tensioning-retaining system during engagement and distribute force associated with the tension over a relatively large surface area.

In an example, a tension-retaining system for retaining tension in a tensioning cord of a wearable article may comprise a retainer including an anchor and a wedge. The anchor may define a notch. The wedge may define a tensioning cord coupling feature. The wedge may have an engagement portion that fits within the notch with the engagement portion disposed further in the notch than the tensioning cord coupling feature. Tension in the tensioning cord thus tends to bias the engagement portion into the notch, helping to retain the wedge in the notch. In an example, the anchor may be coupled to a wearable article, and the tensioning cord coupling feature may couple the tensioning cord to the wedge.

In an aspect, the tension-retaining system may include a holding mechanism holding the wedge in the notch when the engagement portion of the wedge is fit within the notch. The holding mechanism may include a first holding component disposed on the anchor and a second holding component disposed on the wedge and interfitting with the first holding component. In one example, the holding mechanism is magnetic, the first holding component includes one of a magnet or a ferromagnetic material, and the second holding component includes the other of the magnet and the ferromagnetic material. The magnet is magnetically attractive to the ferromagnetic material. In another example in which the holding mechanism is magnetic, the first holding component includes a first magnet, the second holding component includes a second magnet, and the first magnet is magnetically attractive to the second magnet. In another example, the holding mechanism is a snap, the first holding component is one of a socket or a stud that snaps within the socket, and the second holding component is the other of the socket or the stud. In still another example, the holding mechanism is a frictional fit mechanism, the first holding component is one of a contoured surface or a detent that fits to the contoured surface, and the second holding component is the other of the contoured surface or the detent. A variety of configurations of holding mechanisms may be implemented, each configured to releasably secure the engagement portion of the wedge in the notch of the anchor to supplement any biasing force of the tensioning cord. For example, the holding mechanism may be configured to releasably hold the engagement portion of the wedge in the notch even when the biasing force of the cord is minimal or nonexistent.

In an implementation, the wedge may define a pull cord coupling feature that receives a pull cord. The tensioning cord coupling feature may be disposed between the engagement portion and the pull cord coupling feature. The tensioning cord coupling feature may be a tensioning cord passage extending through the wedge. The pull cord coupling feature may be a pull cord passage extending through the wedge. The pull cord passage and the tensioning cord passage may be non-intersecting (e.g., the passages may not intersect with one another). For example, a longitudinal center axis of the pull cord passage may be parallel with a longitudinal center axis of the tensioning cord passage.

In some configurations, the tensioning-retaining system may be configured so that pulling on the pull cord when moving the tensioning-system to an engaged state tends to tip the wedge inward toward the notch (e.g., the front of the wedge at the engagement portion tips in toward the notch) to help align the wedge with the anchor. For example, the wedge may have an inner wall, an outer wall, an upper surface between the inner wall and the outer wall, and a lower surface between the inner wall and the outer wall. The inner wall may be between the wearable article and the outer wall when the anchor is coupled to the wearable article and the wedge is in the notch. The tensioning cord passage and the pull cord passage may extend through the wedge from the upper surface to the lower surface. A longitudinal center axis of the pull cord passage may be a first distance from the inner wall, a longitudinal center axis of the tensioning cord passage may be a second distance from the inner wall, and the second distance may be greater than the first distance.

In an implementation, the anchor may have a base, and the wedge may have an inner wall that seats against the base when the engagement portion of the wedge is in the notch. In an aspect, the anchor may have an outer wall diverging outward from the base. The outer wall may extend to an edge defining an outer extent of the notch. For example, the outer wall may diverge outward from the base at an acute angle.

In a configuration, the wedge may have an outer wall that defines a lip. The lip may engage the edge of the outer wall of the anchor when the engagement portion of the wedge is in the notch. The outer wall of the wedge may be flush with the outer wall of the anchor when the engagement portion of the wedge is in the notch.

In an example, the anchor may have a convex engagement surface in the notch, with the convex engagement surface extending toward the engagement portion of the wedge. The engagement portion of the wedge may have a concave engagement surface that abuts the convex engagement surface of the anchor when the engagement portion of the wedge is in the notch.

In another example, the anchor may have a concave engagement surface in the notch, with the concave engagement surface extending away from the engagement portion of the wedge. The engagement portion of the wedge may have a convex engagement surface that abuts the concave engagement surface of the anchor when the engagement portion of the wedge is in the notch.

In some implementations, the engagement surface of the wedge may be concave in a first direction and convex in a second direction. The engagement surface of the anchor may be convex in the first direction and concave in the second direction.

A wearable article may comprise a body at least partially defining an interior cavity and a closure system for tightening the body around the interior cavity. The closure system may comprise a tensioning cord having a proximal portion operatively secured to the body, and a tension-retaining system that retains tension in the tensioning cord when a distal portion of the tensioning cord is pulled away from the proximal portion. The tension-retaining system may comprise a retainer including an anchor and a wedge. The anchor may be coupled to the body and may define a notch opening away from the proximal portion of the tensioning cord. The wedge may define a tensioning cord coupling feature with the distal portion of the tensioning cord coupled to the wedge at the tensioning cord coupling feature. The wedge may have an engagement portion that fits within the notch with the engagement portion disposed further in the notch than the tensioning cord coupling feature so that tension in the tensioning cord biases the engagement portion of the wedge into the notch.

In an aspect, the wedge may define a pull cord coupling feature and the tensioning cord coupling feature may be disposed between the engagement portion and the pull cord coupling feature. The tension-retaining system may further comprise a pull cord coupled to the wedge at the pull cord coupling feature. The closure system may further comprise a first hook-and-loop fastener component coupled to the pull cord and a second hook-and-loop fastener component secured to a surface of the body with the anchor between the proximal portion of the tensioning cord and the second hook-and-loop fastener component. The first hook-and-loop fastener component may releasably engage with the second hook-and-loop fastener component.

In an example, the wearable article may be an article of footwear and the body may be a footwear upper. In other examples, the wearable article may be a garment, headwear, other apparel, a carry bag such as a backpack, purse, duffel bag, fanny pack, or other portable containment structure intended to be worn on a human body.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 is a perspective view of a wearable article 10, which in the embodiment shown is an article of footwear 10. The article of footwear 10 has a closure system 12 with a tensioning cord 14 and a tension-retaining system 16 for the tensioning cord 14. As further described herein, the tension-retaining system 16 is quickly and securely engaged to retain tension in the tensioning cord 14, thereby tightening a body 18 of the article 10, where the body is an upper 18 of the footwear 10, to a foot of a wearer. As used herein, a wearable article is an article that is configured to be worn on a human body. Non-limiting examples of wearable articles include footwear, a garment, headwear, other apparel, a carry bag such as a backpack, purse, duffel bag, fanny pack, or other portable containment structure intended to be worn on a human body. In the examples shown, the wearable article is an article of footwear and the body is a footwear upper. The upper 18 may be a variety of materials, such as leather, textiles, polymers, cotton, foam, composites, etc. The article of footwear 10 herein is depicted as an athletic shoe or a leisure shoe, but the present teachings also include an article of footwear that is a work shoe, a dress shoe, a sandal, a slipper, a boot, or any other category of footwear.

As used herein, a tensioning cord, such as tensioning cord 14, is a flexible, resiliently elastic or inelastic, elongated tensile element, and is a structure capable of withstanding a tensile load and may include, but is not limited to, a lace, a strand, a wire, a cord, a thread, or a string, among others. A loop portion such as loop portion 14A is a portion that is continuous, and may form a curve but need not be circular or semicircular. For example, a loop portion may be configured as two end portions of the tensioning cord 14 secured to one another.

The tension-retaining system 16 includes a retainer 15 including an anchor 19 and a wedge 21. As is evident in FIGS. 1 and 2, an anchor 19 and a wedge 21 is disposed at both the medial side 32 and the lateral side 34 of the article of footwear 10. Stated differently, the tension-retaining system 16 includes two anchors 19 and two wedges 21. The discussion herein of the anchor 19 and the wedge 21 applies to both the anchor 19 and wedge 21 at the medial side 32, and the anchor 19 and wedge 21 at the lateral side 34. The anchor 19 is coupled to a rear upper portion 18B of the upper 18. The anchor 19 includes a body 23 and a base 25 from which the body 23 extends. The base 25 is secured to the rear upper portion 18B by thermal bonding, adhesive, stitching or otherwise, or may be coupled to a rear sole portion 20B of the footwear 10 and juxtaposed at an outer surface of the rear upper portion 18B. In FIG. 1, the base 25 is shown having an inner side coupled to the rear upper portion 18B and also extending downward and coupled to the rear sole portion 20B. The base 25 may be another configuration or shape than shown in FIG. 1, such as the configuration and shape of the smaller base 25A represented in FIG. 6.

Figure 2:
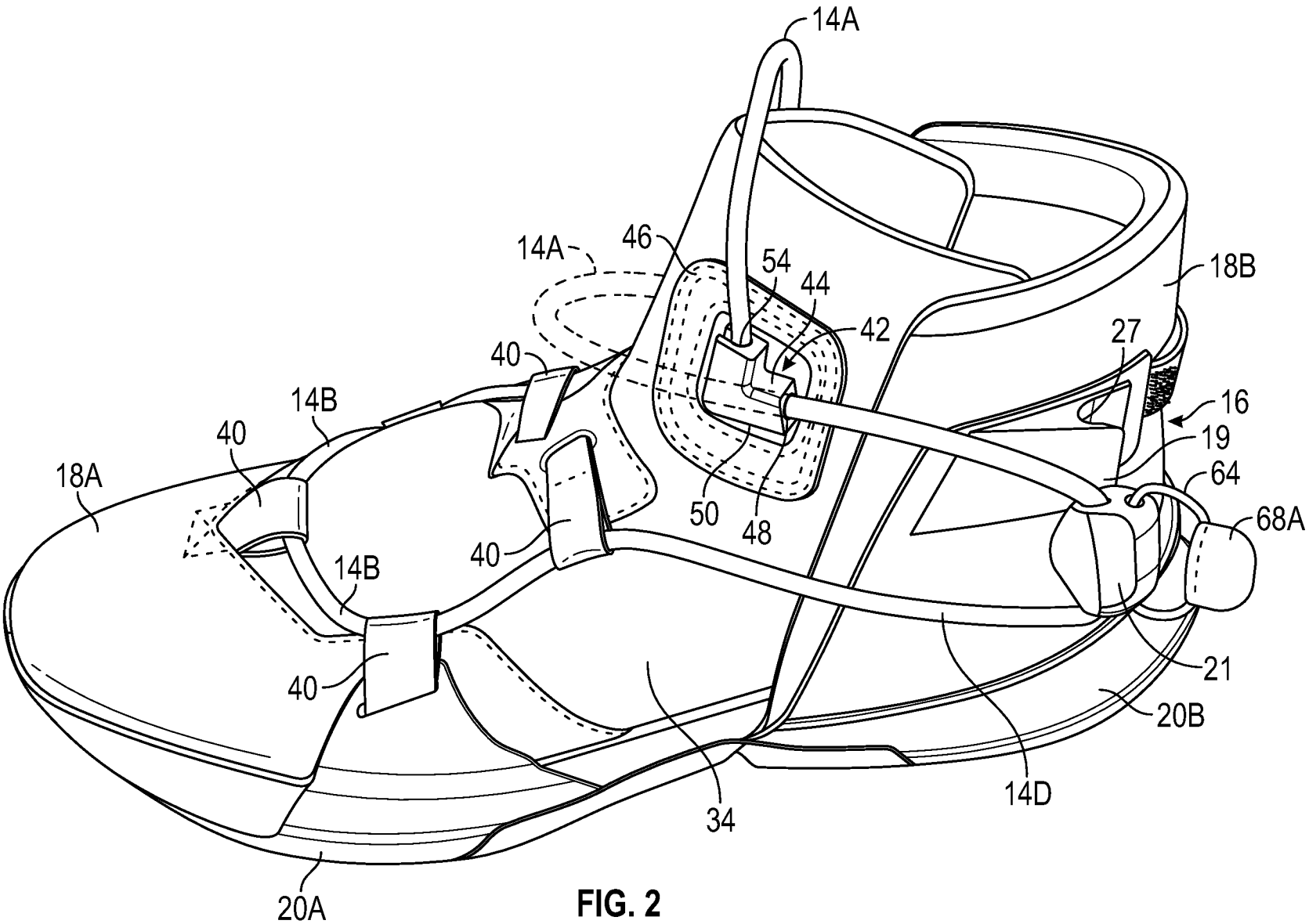
FIG. 2 is a perspective view of a lateral side of the article of footwear of FIG. 1.
Figure 10:
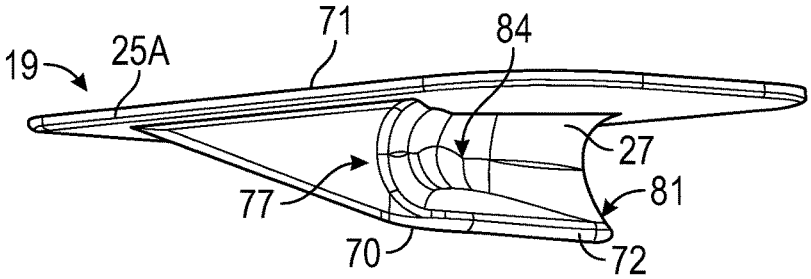
FIG. 10 is a perspective view of a top side of the anchor.

The anchor 19 defines a notch 27. The notch 27 is best shown in FIG. 2 or FIG. 10 where the wedge 21 is not shown engaged with the anchor 19. The tensioning cord 14 has a proximal portion 14B operatively secured to the upper 18 at a front upper portion 18A by cord guides 40 as further discussed herein. The tensioning cord 14 also has a distal portion 14C on the medial side 32 shown in FIG. 1, a distal portion 14D on the lateral side 34 shown in FIG. 2, and a loop portion 14A. The notch 27 opens away from the proximal portion 14B of the tensioning cord 14. For example, the notch 27 opens in a generally rearward direction (e.g., toward a heel region 24 of the article of footwear 10). The tension-retaining system 16 is configured to retain tension in the tensioning cord 14 when the distal portion 14C and/or 14D of the tensioning cord 14 is pulled away from the proximal portion 14B and the wedge 21 is engaged with the anchor 19 in the notch 27 as further discussed herein.

In the embodiment shown, the article of footwear 10 is configured to enable easy donning and removal of the footwear 10 from the foot, and quick and easy adjustment of the fit of the upper 18 to the foot. For example, the footwear upper 18 is configured as a divided footwear upper that includes the front upper portion 18A and the rear upper portion 18B. Additionally, the article of footwear 10 includes a sole structure 20 movable between an access position and a use position (shown). The sole structure 20 has a front sole portion 20A and the rear sole portion 20B. The rear sole portion 20B is pivotable relative to the front sole portion 20A between the use position and an access position for ease of access.

The front upper portion 18A is fixed to the front sole portion 20A and defines a forefoot region 22 and most of a midfoot region 26 of the footwear 10. The rear upper portion 18B is fixed to the rear sole portion 20B and defines the heel region 24 of the footwear 10. The midfoot region 26 of the article of footwear 10 is disposed between the forefoot region 22 and the heel region 24. In the use position, the front upper portion 18A and the rear upper portion 18B together define an ankle opening 28 and an interior cavity 30. The ankle opening 28 leads into the interior cavity 30. A wearer's foot (not shown) is disposed in the interior cavity 30 during use, and the closure system 12 ensures that the footwear upper 18 is tightened around the interior cavity 30 and is secured around the foot with a fit selected by the wearer according to the tension of an adjustment cord 14 as retained by the tension-retaining system 16. Alternatively, articles of footwear that include the tension-retaining system 16 may include a unitary, undivided upper and/or sole structure. For example, the front upper portion 18A and the rear upper portion 18B may be portions of a unitary, undivided upper such as a sock upper or an upper with a throat and a tongue, and/or the sole structure 20 may be a unitary, non-pivoting sole structure.

The heel region 24 generally includes portions of the article of footwear 10 corresponding with rear portions of a human foot, including the calcaneus bone, when the human foot of a size corresponding with the article of footwear 10 is disposed in the interior cavity 30 and is supported on the sole structure 20. The forefoot region 22 of the article of footwear 10 generally includes portions of the article of footwear 10 corresponding with the toes and the joints connecting the metatarsals with the phalanges of the human foot (interchangeably referred to herein as the "metatarsal-phalangeal joints" or "MPJ" joints). The midfoot region 26 of the article of footwear 10 generally includes portions of the article of footwear 10 corresponding with an arch area of the human foot, including the navicular joint. The footwear 10 has the medial side 32 shown in FIG. 1, and the lateral side 34 shown in FIG. 2. Both the medial side 32 and the lateral side 34 extend from the heel region 24 to the forefoot region 22 and are generally opposite sides of the footwear 10 divided by a longitudinal axis LM, which may be a longitudinal midline of the footwear 10.

The rear sole portion 20B pivots relative to the front sole portion 20A at a transverse groove 17 at the bottom of the sole structure 20. The transverse groove 17 is between and is defined by and between the adjacent sole portions 20A, 20B. In the access position, the sole structure 20 is lifted away from a ground surface at the groove 17, which closes or substantially closes the access position. This causes the front upper portion 18A to separate from the rear upper portion 18B, widening the ankle opening 28 to ease foot insertion into the interior cavity 30. For example, in the access position, when the sole structure 20 is on a level ground plane, the sole structure 20 will rest on the front of the front sole portion 20A and on the rear of the rear sole portion 20B, with the midfoot region 26 lifted above the ground plane, the groove 17 closed or substantially closed, and the front sole portion 20A inclining from the front of the front sole portion 20A to the groove 17, and the rear sole portion inclining from the rear of the rear sole portion 20B to the groove 17.

In addition to the cord 14 and the tension-retaining system 16, the closure system 12 includes cord guides 40 anchored to the front upper portion 18A. The cord guides 40 are depicted as flexible but relatively non-elastic loops, and may be a woven or mesh nylon material, or may be other materials or configurations such as webbing, rigid hooks, or eyelets. The adjustment cord 14 is operatively secured to the front upper portion 18A by the cord guides 40. Stated differently, the proximal portion 14B of the adjustment cord 14 is fixed to the front upper portion 18A at the cord guides 40. The cord guides 40 are sleeves through which the cord 14 extends and may slide. Accordingly, the cord 14 is operatively secured to the outer surface of the front upper portion 18A in an indirect manner via the cord guides 40 through which the cord 14 may slide. The cord 14 could instead be operatively secured to the front upper portion 18A indirectly by extending through apertures in the front upper portion 18A, or around hooks secured to the front upper portion 18A. Alternatively, the cord 14 could be stitched or otherwise operatively secured directly to the front upper portion 18A such that it is fixed to the front upper portion 18A in a manner in which it is not slidable relative to the front upper portion 18A.

In some embodiments, the cord 14 may extend from the front upper portion 18A, to the tension-retaining system 16, and then from the tension-retaining system 16 back to the front upper portion 18A where it extends through one or more additional cord guides or is otherwise operatively secured to the front upper portion 18A. In the embodiment of FIG. 1, however, in addition to the cord 14, the tension-retaining system 16, and the cord guides 40, the closure system 12 also includes medial and lateral cord locks 42 to which the adjustment cord 14 may be locked. Locking the cord 14 to the cord locks 42 is done by simply pulling the adjustment cord 14, such as a loop portion 14A of the adjustment cord 14, to tension the cord 14, and pivoting the loop portion 14A of the cord 14 from a first position (an untensioned state, shown in phantom in FIG. 1) to a second position (a locked position, shown in solid lines FIG. 1). Pulling the loop portion 14A concurrently pulls or cinches the upper 18 to adjust its fit over a portion of a wearer. Moving the loop portion 14A to the second position while maintaining the pulling force locks the cord 14 to the lock 42, which retains tension in the cord 14 (e.g., in the portion of the cord 14 between the engaged tension-retaining system 16 and the cord lock 42) even when the pulling force is removed. In other embodiments, the portion 14A need not be a continuous loop, and may instead include a medial end portion of the cord 14 extending through the lock 42 at the medial side 32, and a lateral end portion of the cord 14 extending through the lock 42 at the lateral side 34.

Each lock 42 includes a lock body 44 and a flange 46 integral with the lock body 44 as a unitary component. For example, the bodies 44 and flanges 46 may include a thermoplastic material such as Nylon 12 (PA), also referred to as Nylon polyamide 12 or Nylon (PA12) available from Arkema Inc. in King of Prussia, Pa. USA. Additionally, the thermoplastic material may be reinforced, such as with glass, or may not be reinforced. As another alternative, the bodies 44 and flanges 46 may include a molded rubber material. The flanges 46 are stitched, adhered, thermally bonded, or otherwise secured to the front upper portion 18A.

The cord 14 may be an elastic cord that resiliently stretches to a greater overall length when tensioned, simultaneously reducing in thickness, and then returns to an untensioned thickness and length when tension is released. For example, the cord 14 may include an elastic core of rubber or other resiliently stretchable material that stretches to a greater length as the cord 14 is tensioned. In other examples, the cord 14 may be relatively inelastic such that it does not stretch in overall length when tensioned with the wedge 21 disposed in the notch 27. For example, an inelastic cord 14 may be tensioned and may lock to the lock 42 by a friction fit to the lock body 44, such as by compressing when manually moved in the lock body 44. In the untensioned state of the cord 14 shown in FIG. 1, the cord 14 may have a uniform thickness or diameter both in the loop portion 14A and in the remaining portions 14B, 14C, and 14D. The cord 14 may be a hollow, solid, or stranded core cable. The cord 14 may have a circular cross-section or may have a non-circular cross-section with a cross-sectional area equal to that of a circular cross-section. For example, the cord 14 may be round with a round cross-section, or may be "flat", e.g., with a rectangular cross-section, or may have another cross-sectional shape. In embodiments in which the cord 14 is flat, for example, it may be manually folded along its length at the loop portion 14A when pivoted to a locked position in the cord lock 42. Such a flat cord 14 may be elastic or inelastic.

In FIG. 1, the cord 14 is shown in an untensioned state, as the loop portion 14A of the cord 14 extends through a first passage (e.g., a through hole) in each of the lock bodies 44 from an entrance opening 48 to a first exit opening 50. The loop portion 14A may be pivoted upward to the position shown in FIGS. 1 and 2 (in solid) so that the loop portion 14A extends through a second passage in the lock body 44, the second passage extending from the first passage and exiting the lock body 44 at the second exit opening 54. The lock body 44 has a slot extending through its outer surface between the first exit opening 50 and the second exit opening 54 and extending to the passages to enable pivoting of the loop portion 14A to the locked position. After pivoting, when the force pivoting the loop portion 14A is released, the cord 14 is biased to return to its untensioned state, e.g., a slack state, including returning to its full diameter if the cord 14 is elastic. The second passage including the second exit opening 54 is smaller in diameter than the first passage and the first exit opening 50. Accordingly, in the tensioned and locked state of FIG. 1, the cord 14 locks to the bodies 44 by filling the second passage.

The cord 14 may be locked to the lock bodies 44 before or after the tension-retaining system 16 is engaged at each of the medial and lateral sides 32, 34. The cord 14 is effectively fixed at the cord guides 40 and the locked lock bodies 44 at the front upper portion 18A, and the tension-retaining system 16 provides a connection to the rear upper portion 18B so that the tension in the cord 14 helps to retain the rear upper portion 18B and the front upper portion 18A together in the use position and closed around a foot in the interior cavity 30. Because the cord 14 effectively zig-zags over the upper 18, extending from the forefoot region 22 at the cord guides 40, to the tension-retaining system 16 at the medial and lateral sides 32, 34 of the heel region 24, and then through the lock bodies 44 generally in the midfoot region 26 forward of the tension-retaining system 16 and higher on the footwear 10 than the cord guides 40, the tightening effect of the tensioned cord 14 is distributed over the upper 18 both front to rear and top to bottom.

Figure 3:
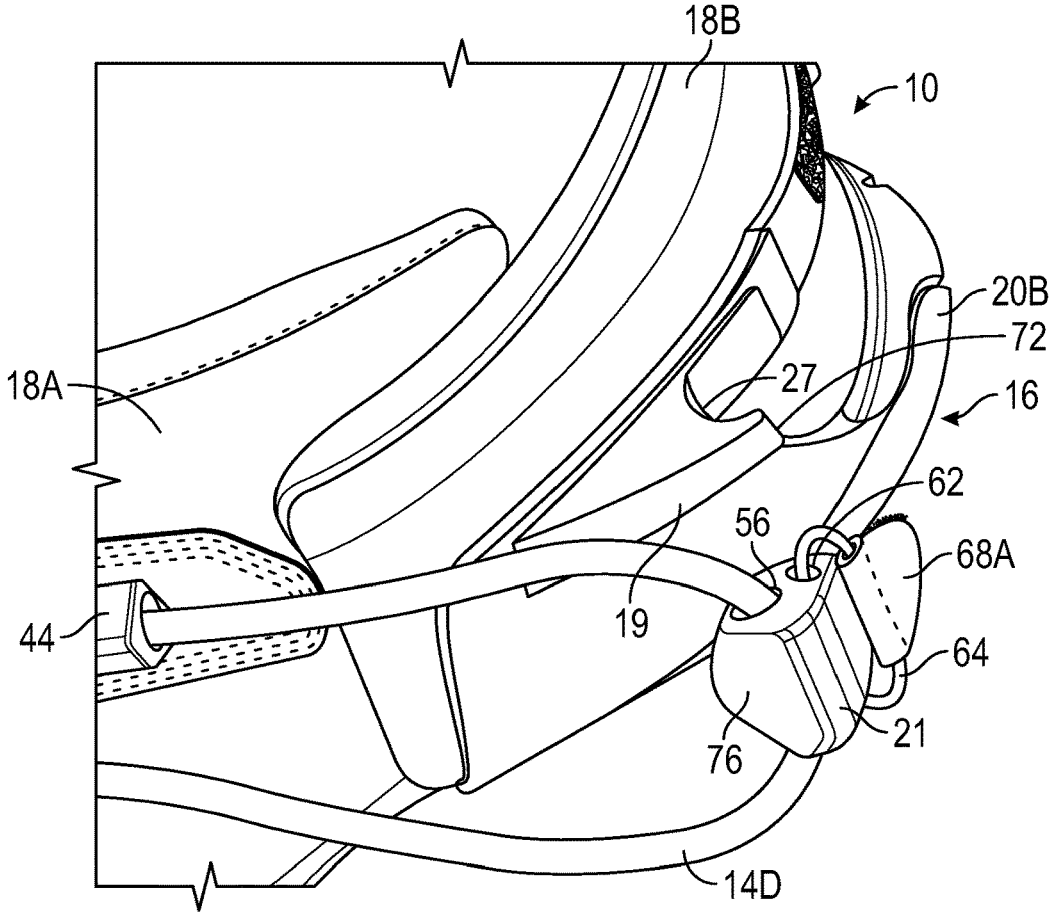
FIG. 3 is a fragmentary perspective view of the article of footwear of FIG. 1 with the tension-retaining system in a disengaged state.

Referring to FIG. 3, which shows the tension-retaining system 16 in the disengaged state, the wedge 21 defines a tensioning cord coupling feature 56 by which the tensioning cord 14 is coupled to the wedge 21. In the embodiment shown, the tensioning cord coupling feature is a tensioning cord passage 56 that extends through the wedge 21 as a through hole. The distal portion 14D of the tensioning cord 14 extends through the tensioning cord passage 56. In other embodiments, the tensioning cord coupling feature could be adhesive or a fastener, such as a pin, that couples the tensioning cord 14 to the wedge 21.

Figure 4:
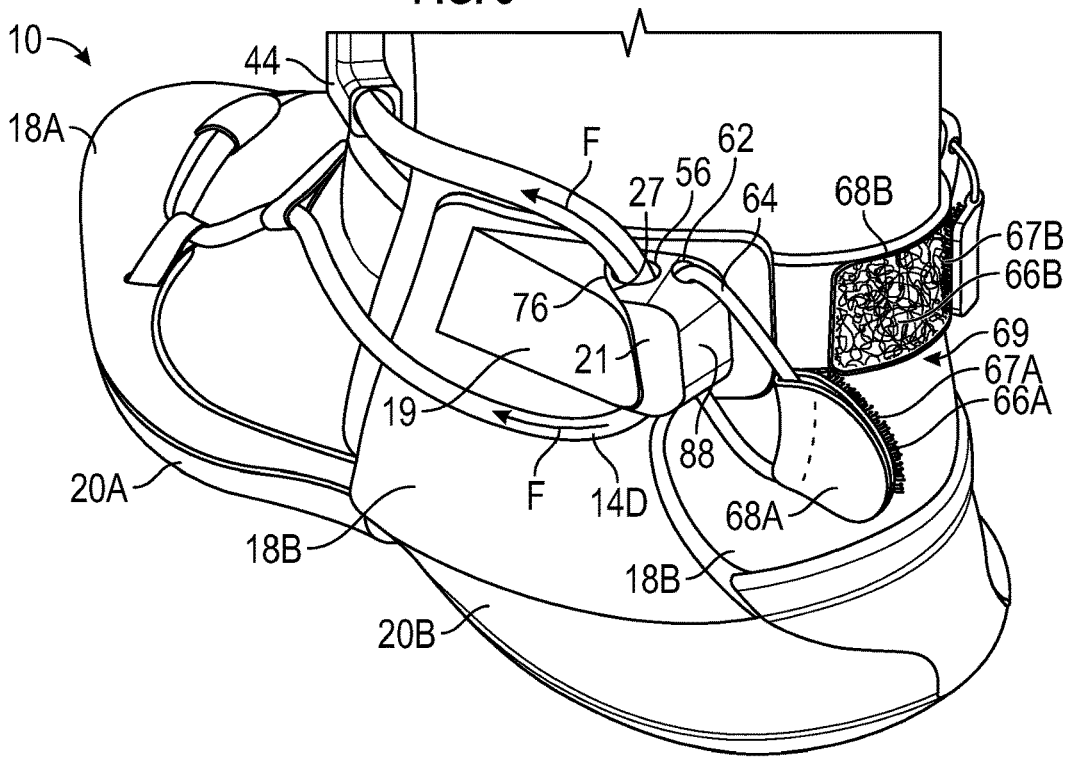
FIG. 4 is a rear perspective fragmentary view of the article of footwear of FIG. 1 with the tension-retaining system in an engaged state.

The wedge 21 has an engagement portion 76 that fits within the notch 27 of the anchor 19. When the tension-retaining system 16 is in the engaged state as shown in FIG. 4, the engagement portion 76 is disposed further in the notch 27 than the tensioning cord coupling feature (e.g., the engagement portion 76 is further toward the front of the notch 27 than is the tensioning cord passage 56) so that tension in the tensioning cord 14, represented by forces F, biases the engagement portion 76 of the wedge 21 into the notch 27. The engagement portion of the wedge 21 is that portion of the wedge 21 that is in contact with the anchor 19 when the wedge 21 is in the notch 27 in the engaged state.

In order to releasably hold the wedge in the notch even in the absence of any biasing force of the cord 14, the tension-retaining system 16 and/or any of the other tensioning-retaining systems 116, 216, 316, 416, and 516 described herein may include a holding mechanism holding the wedge in the notch when the engagement portion of the wedge is fit within the notch. The holding mechanism is described with respect to the tension-retaining system 16, but the description applies equally to tension-retaining systems 116, 216, 316, 416, and 516. The holding mechanism may include a first holding component disposed on the anchor 19 and a second holding component disposed on the wedge 21 and interfitting with the first holding component. In one example, the holding mechanism is magnetic, the first holding component includes one of a magnet or a ferromagnetic material, and the second holding component includes the other of the magnet and the ferromagnetic material. The magnet is magnetically attractive to the ferromagnetic material. In another example in which the holding mechanism is magnetic, the first holding component includes a first magnet, the second holding component includes a second magnet, and the first magnet is magnetically attractive to the second magnet. In another example, the holding mechanism is a snap, the first holding component is one of a socket or a stud that snaps within the socket, and the second holding component is the other of the socket or the stud. In still another example, the holding mechanism is a frictional fit mechanism, the first holding component is one of a contoured surface or a detent that fits to the contoured surface, and the second holding component is the other of the contoured surface or the detent. A variety of configurations of holding mechanisms may be implemented, each configured to releasably secure the engagement portion of the wedge 21 in the notch 27 of the anchor 19 to supplement any biasing force of the tensioning cord 14. For example, the holding mechanism may be configured to releasably hold the engagement portion 76 of the wedge 21 in the notch 27 even when the biasing force of the cord 14 is minimal or nonexistent.

FIGS. 3 and 4 also show that the wedge 21 defines a pull cord tensioning feature 62 by which a pull cord 64 is coupled to the wedge 21. In the embodiment shown, the pull cord tensioning feature is a pull cord passage 62 extending through the wedge 21 as a through hole. The pull cord passage 62 receives a pull cord 64, which extends through the pull cord passage 62 and may be considered part of the tension-retaining system 16. In other embodiments, the pull cord coupling feature could be adhesive or a fastener, such as a pin, that couples the pull cord 64 to the wedge 21. The tensioning cord passage 56 is disposed between the engagement portion 76 and the pull cord passage 62. The pull cord 64 may be easier for a wearer to manipulate as opposed to directly gripping the wedge 21, and a wearer can grab the pull cord 64 and pull rearward and then slightly inward toward the rear upper portion 18B (after the engagement portion 76 clears an edge 72 of the anchor 19 at the notch 27) to guide the wedge 21 into the notch 27. The relative positions of the tensioning cord passage 56 and the pull cord passage 62 and their ability to ease engagement of the wedge 21 with the anchor 19 is discussed further with respect to FIG. 13.

Figure 5:
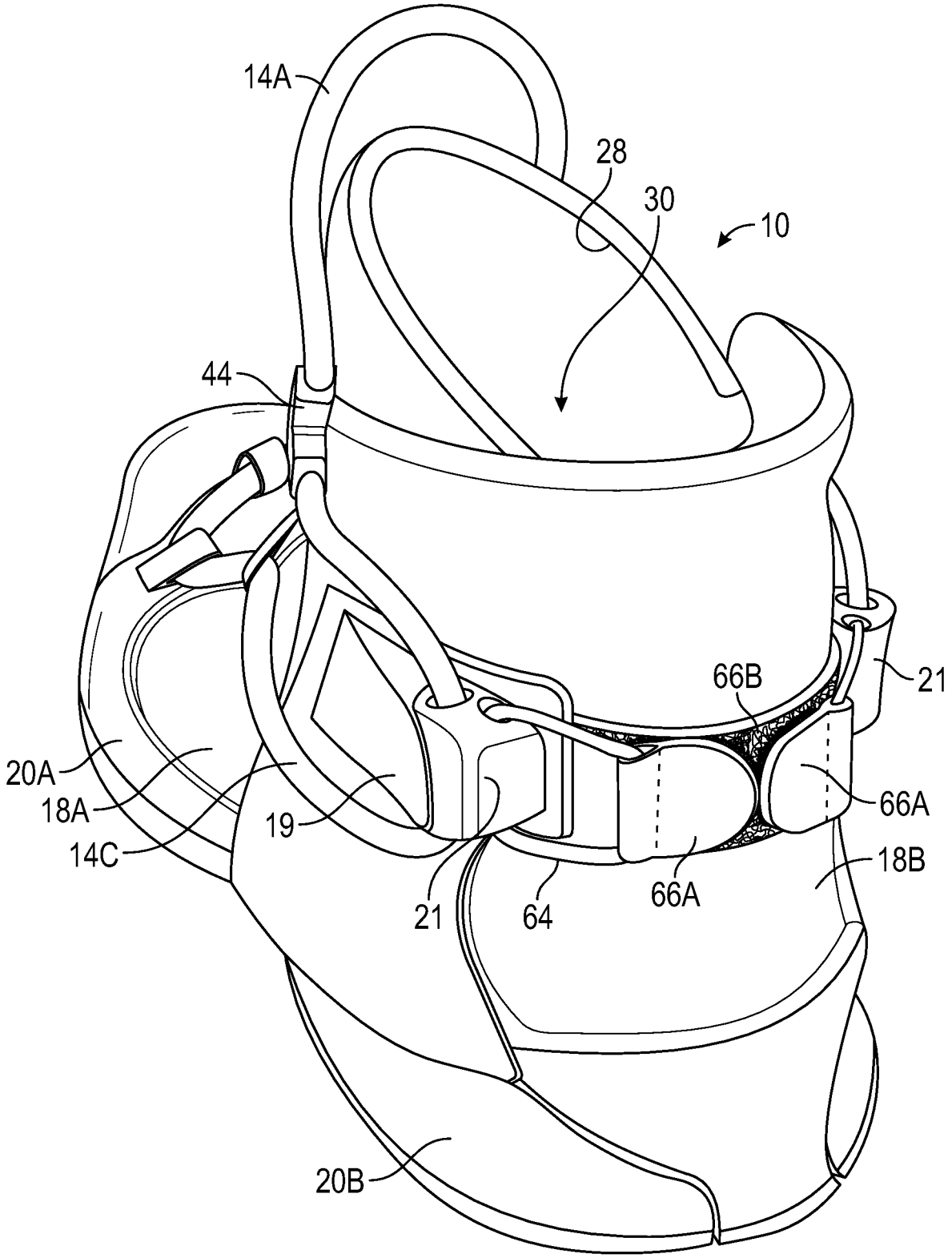
FIG. 5 is another rear perspective view of the article of footwear of FIG. 1 with a hook-and-loop fastener on a pull cord in a secured state.

As shown in FIGS. 3 and 4, the closure system 12 includes a first hook-and-loop fastener component 66A coupled to the pull cord 64 such as by stitching a backing 68A of the fastener component 66A around the pull cord 64. A second hook-and-loop fastener component 66B has a backing 68B secured to a rear-facing surface 69 of the rear upper portion 18B. The first hook-and-loop fastener component 66A releasably engages with the second hook-and-loop fastener component 66B. For example, the first hook-and-loop fastener component 66A includes a plurality of hooks 67A and the second hook-and-loop fastener component 66B includes a plurality of loops 67B. When the first hook-and-loop fastener component 66A is manually pressed against the second hook-and-loop fastener component 66B with the hooks 67A contacting the loops 67B, the hooks 67A engage with the loops 67B as shown in FIG. 5. The first hook-and-loop fastener component 66A could instead include a plurality of loops and the second hook-and-loop fastener component 66B could include a plurality of hooks, or both fastener components 66A, 66B could include both hooks and loops to enable the first hook-and-loop fastener component 66A to releasably engage with the second hook-and-loop fastener component 66B.

The engagement of the hook-and-loop fastener components 66A, 66B wraps the pull cord 64 close against the rear upper portion 18B to prevent it from dangling and possibly inadvertently catching on an object when the footwear 10 is worn. Additionally, because the anchor 19 is between the proximal portion 14B of the tensioning cord 14 and the second hook-and-loop fastener component 66B, with the distal portion 14C of the tensioning cord 14 (where it extends through the tensioning cord passage 56) between the anchor 19 and the second hook-and-loop fastener component 66B, the engaged fastener components 66A, 66B act as a backup to the engaged wedge 21 and anchor 19 to retain tension in the tensioning cord 14. For example, if the wedge 21 was inadvertently removed from the notch 27 during wear, the engaged fastener components 66A, 66B would prevent the cord 14 from releasing tension and returning toward the front upper portion 18A.

The anchor 19, wedge 21, pull cord 64 and first fastener component 66A are described with respect to these components on the lateral side 34 of the footwear 10 in FIGS. 2-4. The tension-retaining system 16 may include an anchor 19, wedge 21, pull cord 64 and first fastener component 66A disposed at the medial side 32 of the footwear 10 in the same manner as those on the lateral side 34, as shown in FIG. 1. The description of the components of the tension-retaining system 16 applies to components of the tension-retaining system 16 on the lateral side 34 and to components of the tension-retaining system 16 on the medial side 32. As shown in FIG. 5, the second fastener component 66B is sufficiently long that both of the first fastener components 66A (e.g., the first fastener component 66A at the medial side 32 and the first fastener component at the lateral side 34) can be releasably engaged with the second fastener component 66B at the same time.

Figure 6:
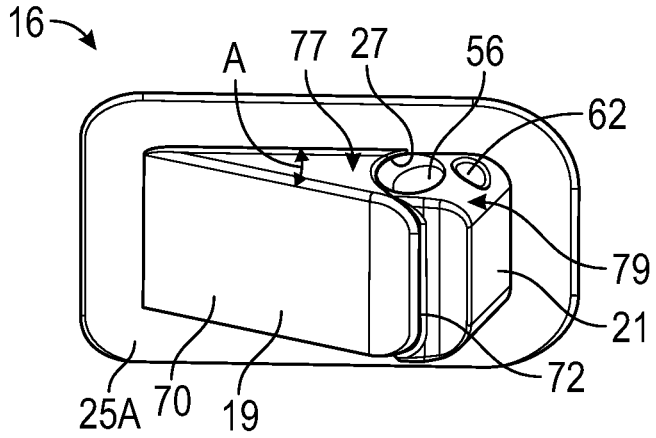
FIG. 6 is a perspective view of the tension-retaining system of FIG. 1 in an engaged state.
Figure 7:
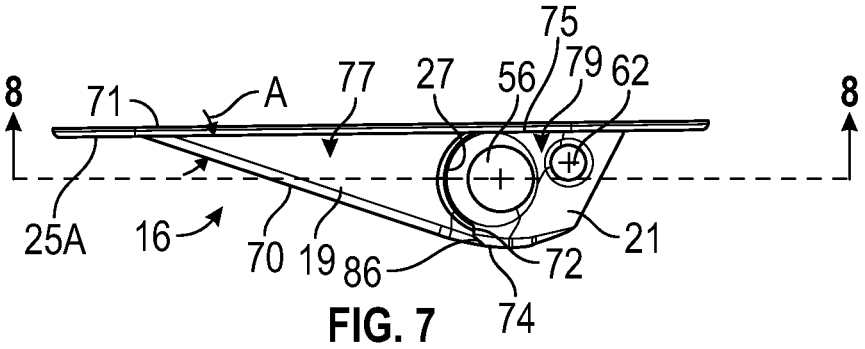
FIG. 7 is a top view of the tension-retaining system of FIG. 1.

FIG. 6 is a perspective view of the tension-retaining system 16 in an engaged state with the tensioning cord 14 and the pull cord 64 not shown for clarity. The alternate base 25A is shown, and the description applies equally to base 25. As shown in FIG. 7, the anchor 19 has an outer wall 70 and an inner wall 71. The outer wall 70 diverges outward from the base 25A at an acute angle A. The outer wall 70 extends to an outer edge 72 that defines an outer extent of the notch 27. As shown in FIG. 7, the wedge 21 has an outer wall 74 and an inner wall 75. A forward extent of the outer wall 74 is flush with the outer wall 70 of the anchor 19 when an engagement portion 76 of the wedge 21 (described with respect to FIG. 11) is in the notch 27 and engaged with the anchor 19.

The top view of FIG. 7 shows an upper surface 77 of the anchor 19 extending between the inner wall 71 and the outer wall 70. An upper surface 79 of the wedge 21 extends between the inner wall 75 and the outer wall 74. The inner wall 71 of the anchor 19 is between the rear upper portion 18B and the outer wall 70 when the anchor 19 is coupled to the rear upper portion 18B. The inner wall 75 of the wedge 21 is between the inner wall 71 of the anchor 19 and the outer wall 74 of the wedge 21 when the wedge 21 is in the notch 27. The inner wall 75 seats against the base 25A when the engagement portion 76 of the wedge 21 is in the notch 27. For example, as shown in FIG. 7, the inner wall 75 and the base 25A are both relatively planar where the inner wall 75 seats against the base 25A. When secured to the rear upper portion 18B, the base 25 or 25A may be flexible to conform to a curvature of the rear upper portion 18B, as shown in FIG. 1. The inner wall 75 of the wedge 21 may have a curvature that enables it to be coincident with the curvature of the base 25 or 25A.

Figure 8:
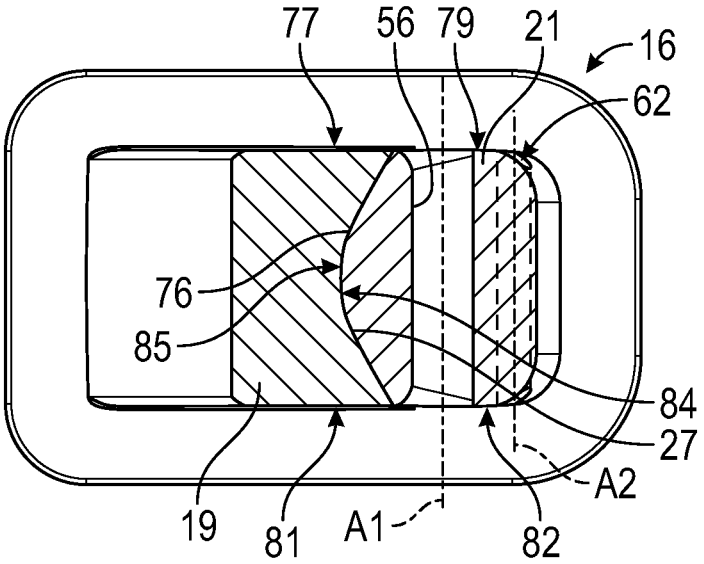
FIG. 8 is a cross-sectional view of the tension-retaining system of FIG. 1 taken at lines 8-8 in FIG. 7.

FIG. 8 is a cross-sectional view of the tension-retaining system taken at lines 8-8 in FIG. 7. FIG. 8 shows a lower surface 81 of the anchor 19 that extends between the inner wall 71 and the outer wall 70 of FIG. 7, and a lower surface 82 of the wedge 21 that extends between the inner wall 75 and the outer wall 74 of FIG. 7. FIG. 8 best shows that both the tensioning cord passage 56 and the pull cord passage 62 (indicated with hidden lines) as through holes that extend completely through the wedge 21 from the upper surface 79 to the lower surface 82 (e.g., opening at the upper surface 79 and at the lower surface 82). Additionally, the tensioning cord passage 56 and the pull cord passage 62 are straight, cylindrical passages and are non-intersecting (e.g., they do not intersect with one another). A longitudinal center axis A1 of the tensioning cord passage 56 and a longitudinal center axis A2 of the pull cord passage 62 are parallel with one another.

Figure 13:
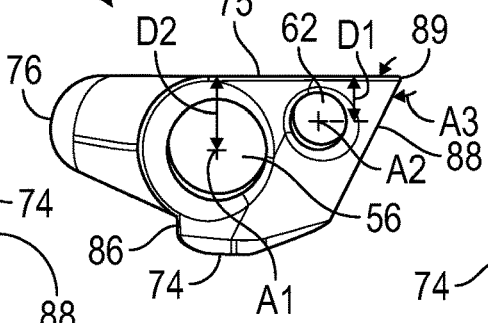
FIG. 13 is a top view of the wedge.

Referring to FIG. 13, the longitudinal center axis A2 of the pull cord passage 62 is a first distance D1 from the inner wall 75 of the wedge 21, and the longitudinal center axis A1 of the tensioning cord passage 56 is a second distance D2 from the inner wall 75 (with the first distance D1 and the second distance D2 measured parallel to one another). The second distance D2 is greater than the first distance D1. Due to this differential offset in the axes A1, A2 from the inner wall 75, a tensile force (e.g., tensile force F in FIG. 20) in the distal portion 14C of the cord 14 created in reaction to a force pulling on the pull cord 64 (e.g., force F1 in FIG. 20) will align with the opposing pull cord force F1 when moving the tensioning-retaining system 16 to an engaged state by tipping the wedge 21 inward toward the notch 27 (e.g., the front of the wedge 21 at the engagement portion 76 automatically tips in toward the notch 27 and the inner wall 71) to help align the wedge 21 with the anchor 19. The tipping movement is discussed in further detail with respect to the tensioning-retaining system 216 of FIGS. 17-28 and applies equally to the tension-retaining system 16.

Figure 11:
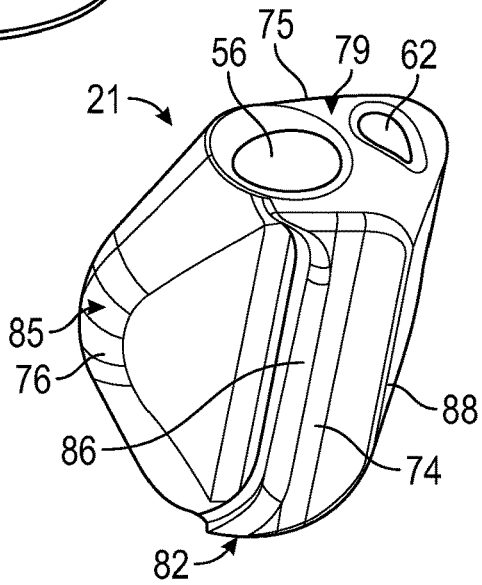
FIG. 11 is a perspective view of an outer side of a wedge of the tension-retaining system of FIG. 1.

In addition to the automatic tip in of the wedge 21, the tension-retaining system 16 has other features configured to ensure quick and accurate engagement of the wedge 21 with the anchor 19. For example, as shown in FIG. 8, the anchor 19 has a concave engagement surface 84 in the notch 27. The engagement portion 76 of the wedge 21 has a convex engagement surface 85 that abuts the concave engagement surface 84 of the anchor 19 when the engagement portion 76 of the wedge 21 is in the notch 27. The concave engagement surface 84 extends away from the engagement portion 76 of the wedge 21. As best shown in FIGS. 8, 11 and 13, the convex engagement surface 85 is convex in two directions: in a direction from the upper surface 79 to the lower surface 82 of the wedge 21, and in a direction from the inner wall 75 to the outer wall 74 of the wedge 21. This creates a peak on the wedge 21. As best shown in FIGS. 8 and 10, the concave engagement surface 84 is likewise concave in two directions: in a direction from the inner wall 71 to the outer wall 70 of the anchor 19, and in a direction from the upper surface 77 to the lower surface 81 of the anchor 19. The concave engagement surface 84 and the convex engagement surface 85 are thus configured to automatically center the wedge 21 to the anchor 19 during engagement. Stated differently, the tensioning force on the wedge 21 will tend to cause the wedge 21 to slide its peak toward the center of the notch 27 so that the engagement surfaces 84, 85 are fully in contact with one another. Forces associated with the tension of the tensioning cord 14 biasing the wedge 21 against the anchor 19 in the notch 27 are distributed over a relatively large surface area due to the mating concave and convex shapes. Stated differently, the surface areas of the concave engagement surface 84 and the convex engagement surface 85 are larger than if the engagement surfaces of the wedge 21 and the anchor 19 were planar, and were not concave or convex in either of the two directions in which the surfaces 84 and 85 are concave and convex, respectively.

Another feature that helps with accurate and secure engagement of the wedge 21 to the anchor 19 is a lip 86 in the outer wall 74 of the wedge 21 that fits to and engages the outer edge 72 of the outer wall 70 of the anchor 19. The concave shape of the surface 84 of the notch 27 inward of the outer edge 72 and the convex shape of the surface 85 of the engagement portion 76 ensures that the engagement portion 76 extends past the outer edge 72 in the notch 27 (e.g., further toward the forefoot region 22 of the footwear 10 than the outer edge 72). The biasing force of the tensioning cord 14 in combination with the outer edge 72 extending further back than and partially wrapping around the engagement portion 76 will help to prevent the wedge 21 from slipping out of the notch 27 during wear of the footwear 10.

Figure 9:
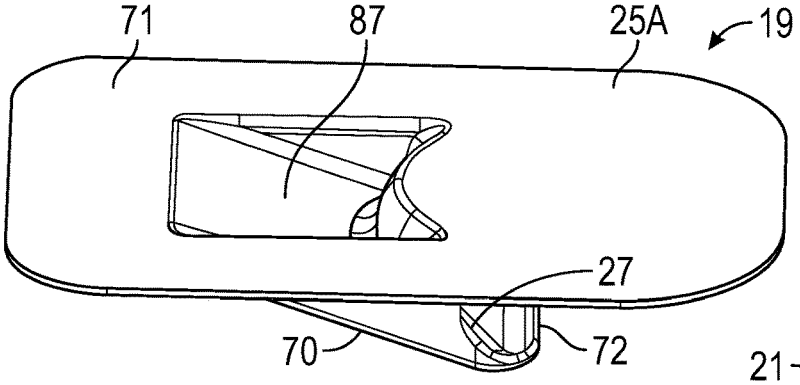
FIG. 9 is a perspective view of an inner side of an anchor of the tension-retaining system of FIG. 1.

FIG. 9 is a perspective view of an inner side of an anchor 19 of the tension-retaining system 16. The inner wall 71 is shown having a recess 87 where the outer wall 70 angles outward from the base 25A. The recess 87 helps to reduce the weight and material used for the anchor 19 in comparison to an anchor without a recess in the location shown.

Figure 12:
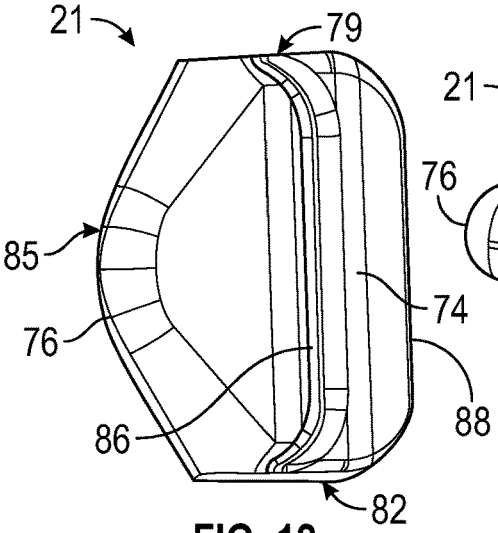
FIG. 12 is another perspective view of the outer side of the wedge.
Figure 14:
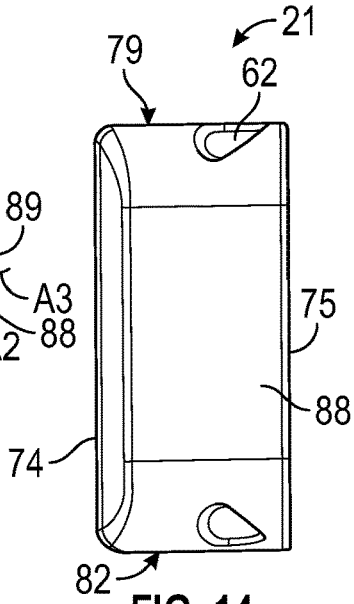
FIG. 14 is a rear view of the wedge.

FIG. 10 is a perspective view of a top side of the anchor 19 showing the upper surface 77 and indicating the concavity of the notch 27 between the upper surface 77 and the lower surface 81. FIGS. 11 and 12 are different perspective views of an outer side of the wedge 21 (e.g., showing the outer wall 74) of the tension-retaining system 16. FIG. 12, for example, illustrates that the upper surface 79 and the lower surface 82 are generally flat and parallel with one another until they converge with a rear wall 88. Stated differently, the edges of the wedge 21 between the upper surface 79 and the rear wall 88, and between the lower surface 82 and the rear wall 88, are rounded. FIGS. 13 and 14 show that the rear wall 88 is generally planar and FIG. 13 shows that the rear wall 88 diverges from the inner wall 75 at an acute angle A3. As shown in FIG. 13, a portion of the tensioning cord passage 56 extends past the lip 86 toward the engagement portion 76. Stated differently, at least a portion of the tensioning passage 56 is further rearward than the lip 86. This helps to ensure continuous engagement of the engagement portion 76 with the notch 27 when the tensioning cord 14 biases the wedge 21 against the notch 27. The longitudinal center axis A2 of the tensioning cord passage 56 is rearward of the lip 86 (e.g., further toward the rear wall 88 than the lip 86). Accordingly, when an opposing force is applied to the pull cord 64 (e.g., a force like force F1 in FIG. 20), the rear edge 89 of the wedge 21 will tip away from the base 25 or 25A (in an opposite rotation from the tip in of the front of the wedge 21 at the engagement portion 76 discussed herein) and the lip 86 will roll outward along the outer edge 72 to assist the user in pulling the wedge 21 out of the notch 27.

Figure 15:
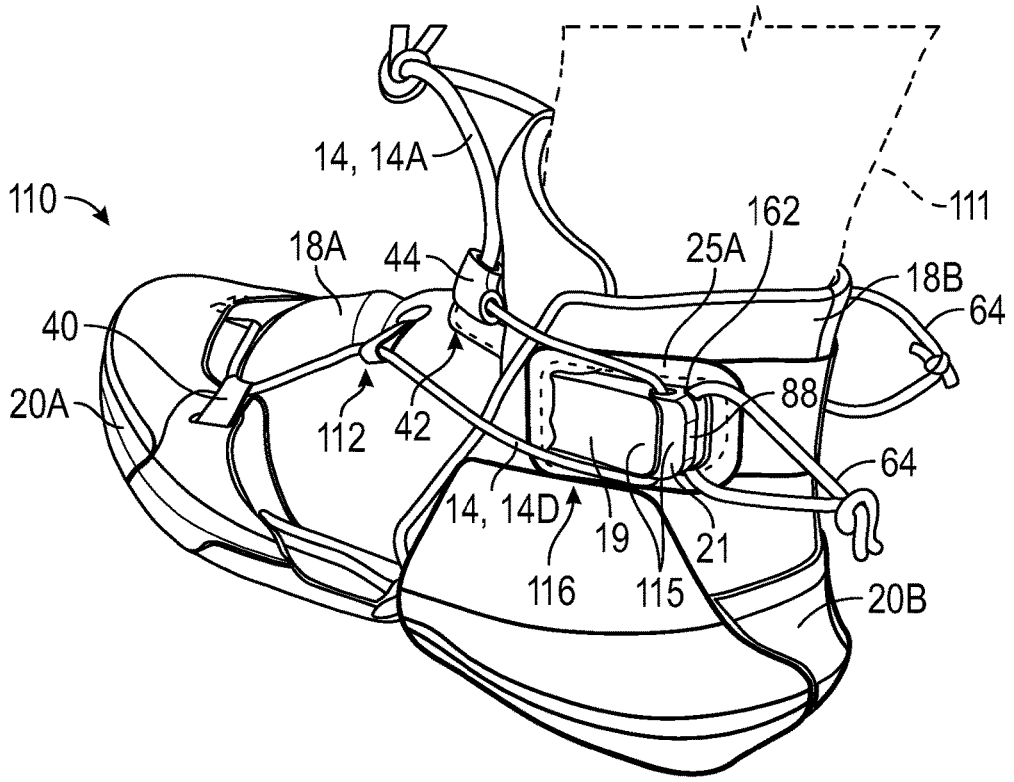
FIG. 15 is a perspective view of a lateral side of an article of footwear having a closure system with a tensioning cord and a tension-retaining system for the tensioning cord in an engaged state.

FIG. 15 is a perspective view of a lateral side of another embodiment of an article of footwear 110 having a closure system 112 with a tensioning cord 14 and a tension-retaining system 116 for the tensioning cord 14, with the tension-retaining system 116 in an engaged state. The article of footwear 110, closure system 112, and tensioning-retaining system 116 including a retainer 115 are alike in all aspects to footwear 10, closure system 12, tension-retaining system 16 and retainer 15 described with respect to FIGS. 1-5 except that the anchor 19 includes the base 25A of FIG. 6 coupled to (e.g., stitched to) the rear upper portion 18B instead of extending downward to the rear sole portion 20B, the wedge 21 has a pull cord passage 162 that intersects with and is partially open at the rear wall 88, there are no fastener components 66A, 66B to releasably engage and connect the pull cord 64 to the rear upper portion 18B, the cord 14 has ends knotted together at the pull loop portion 14A, and each pull cord 64 has ends knotted together.

Figure 16:
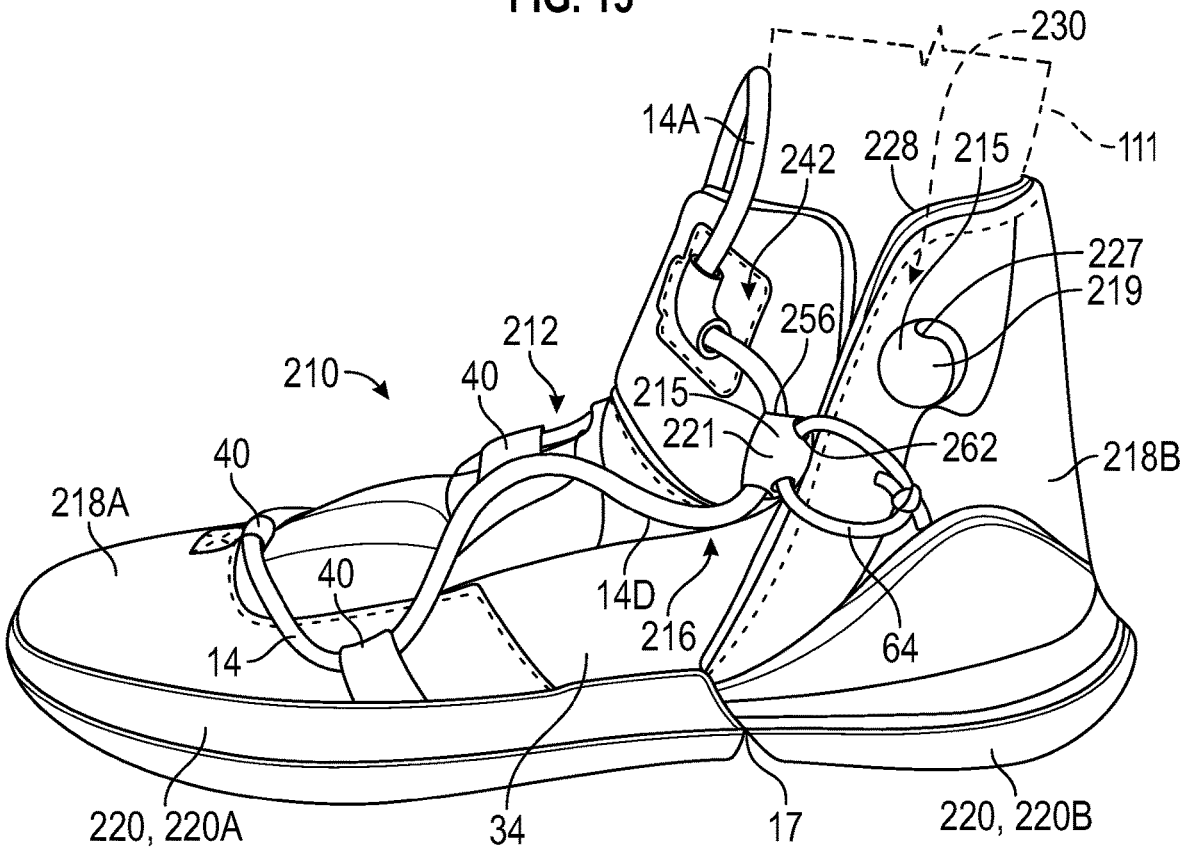
FIG. 16 is a perspective view of a lateral side of an article of footwear having a closure system with a tensioning cord and a tension-retaining system for the tensioning cord in a disengaged state.

FIG. 16 is a perspective view of a lateral side 34 of another embodiment of an article of footwear 210 having a closure system 212 with a tensioning cord 14 and a tension-retaining system 216 for the tensioning cord 14, with the tension-retaining system 216 shown in a disengaged state. The article of footwear 210 includes a sole structure 220 with a front sole portion 220A and a rear sole portion 220B pivotable at a transverse groove 17 from the use position shown to an access position, as described with respect to the sole structure 20 of the article of footwear 10. The article of footwear 210 includes a front upper portion 218A secured to the front sole portion 220A, and a rear upper portion 218B secured to the rear sole portion 220B. The front upper portion 218A and the rear upper portion 218B together define an ankle opening 228 and an interior cavity 230. A foot attached to the leg 111 shown is received through the ankle opening 228 and is supported on the sole structure 220 in the interior cavity 230.

The closure system 212 includes the cord guides 40 as described, and a cord lock 242 having a slightly different shape but functioning identically as described with respect to cord lock 42. The tensioning-retaining system 216 includes a retainer 215 that includes an anchor 219 and a wedge 221. The anchor 219 is coupled to the rear upper portion 218B. The wedge 221 has a tensioning cord coupling feature 256 and a pull cord coupling feature 262. In the embodiment shown, the tensioning cord coupling feature 256 is a tensioning cord passage 256 and the pull cord coupling feature 262 is a pull cord passage 262 both of which extend through the wedge 221 as non-intersecting through holes. The tensioning cord 14 passes through the tensioning cord passage 256 and the pull cord 64 passes through the pull cord passage 262. In other embodiments, either or both of the tensioning cord coupling feature 256 and the pull cord coupling feature 262 could be adhesive or a fastener, such as a pin, that couples the tensioning cord 14 to the wedge 221 and the pull cord to the wedge 221, respectively. The tension-retaining system 216 includes another cord lock 242, anchor 219, wedge 221, and pull cord 64 disposed at the medial side (not shown) of the article of footwear 210 and arranged relative to one another as the corresponding components shown on the lateral side 34.

Figure 17:
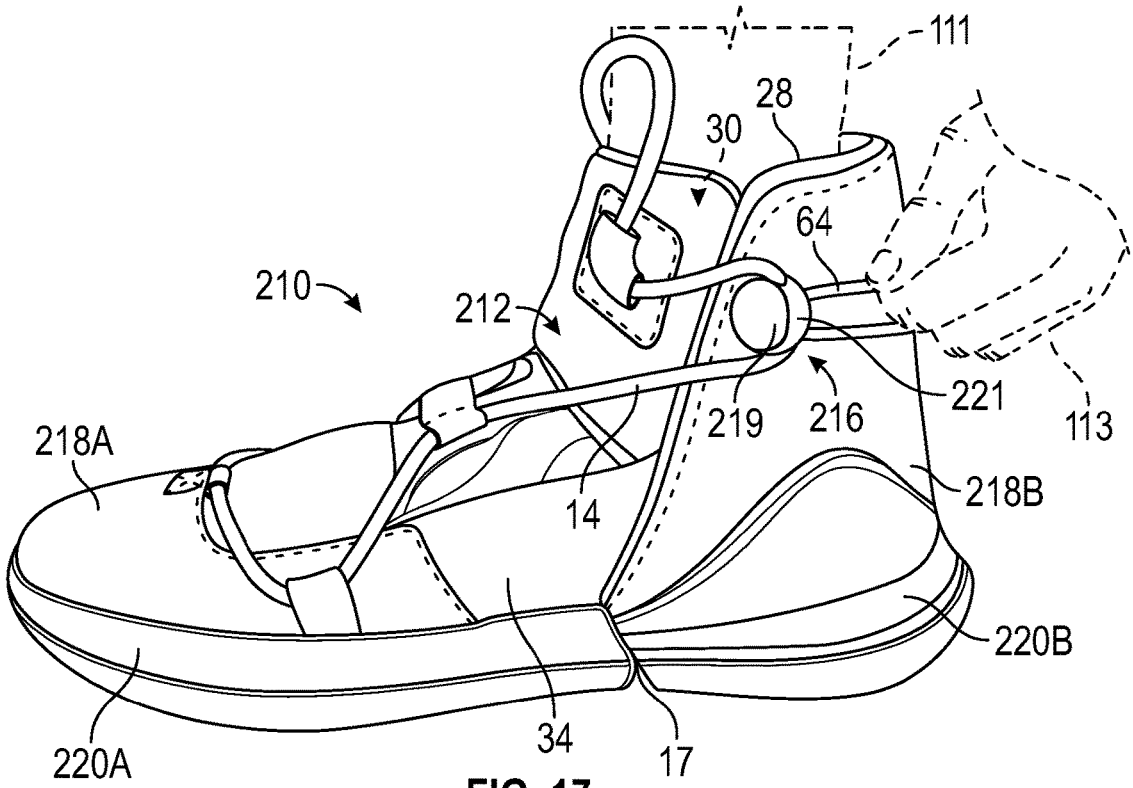
FIG. 17 is a perspective view of the lateral side of the article of footwear of FIG. 16 with the tension-retaining system moved to an engaged state.

FIG. 17 is a perspective view of the lateral side 34 of the article of footwear 210 of FIG. 16 with the tension-retaining system 216 moved to an engaged state in which an engagement portion 276 (see FIG. 18) of the wedge 221 is received within a notch 227 (see FIG. 20) of the anchor 219 to retain tension in the tensioning cord 14. A hand 113 is shown pulling on the pull cord 64 to tension the cord 14 and guide the wedge 221 into the notch 227 of the anchor 219.

Figure 18:
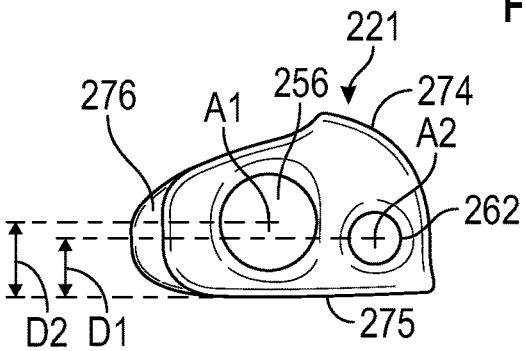
FIG. 18 is a bottom view of a wedge of the tension-retaining system of FIG. 17.
Figure 19:
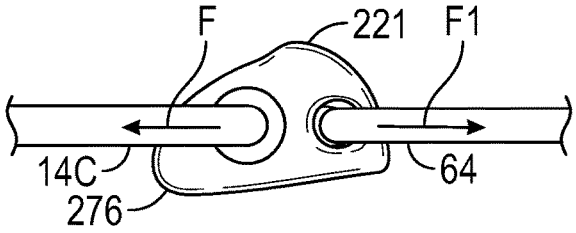
FIG. 19 is a bottom view of the wedge of FIG. 18 with a tensioning cord and a pull cord extending through the wedge and under tension.
Figure 20:
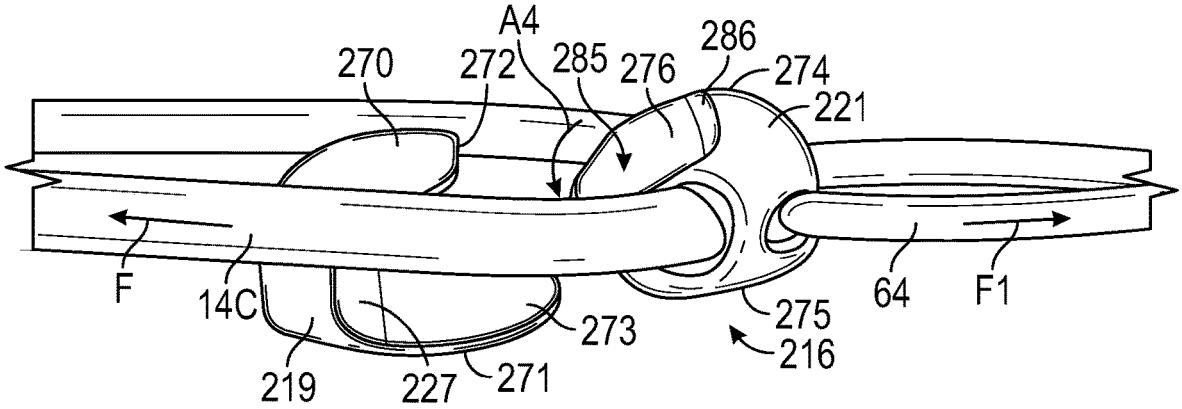
FIG. 20 is a bottom perspective view of the wedge, tensioning cord, and pull cord of FIG. 19 with the wedge being aligned with a notch in an anchor of the tension-retaining system of FIG. 17.

FIG. 18 is a bottom view of the wedge 221. The longitudinal center axis A2 of the pull cord passage 262 is a first distance D1 from the inner wall 275 of the wedge 221. The longitudinal center axis A1 of the tensioning cord passage 256 is a second distance D2 from the inner wall 275. The second distance D2 is greater than the first distance D1. As shown in FIG. 20, a tensile force F in the distal portion 14C of the cord 14 created in reaction to a force F1 pulling on the pull cord 64 (see FIG. 19) will align with the opposing pull cord force F shown in FIG. 20 (placing the center axes A1, A2 also in alignment with the forces F, F1) when moving the tensioning-retaining system 216 to an engaged state, and due to the differential in the offset of the axes A1, A2 from the inner wall 275, causes tipping of the wedge 221 inward toward the notch 227 (e.g., the front of the wedge 221 at the engagement portion 276 tips in toward the inner wall 271 in the notch 227, rotating inward from a position like that of FIG. 18 to a position like that of FIG. 19 or 20, as illustrated by the rotational arrow A4 in FIG. 20), which helps align the wedge 221 with the notch 227 of the anchor 219.

Figure 21:
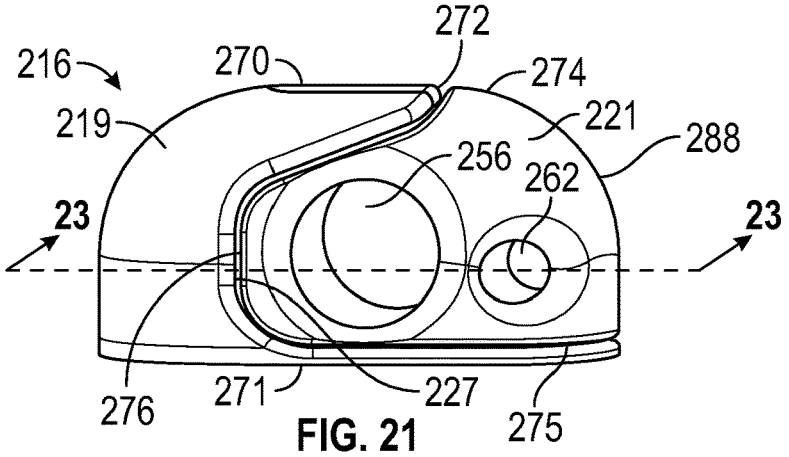
FIG. 21 is a bottom view of the wedge and anchor of the tension-retaining system of FIG. 17 in an engaged state.

FIG. 21 is a bottom view of the tension-retaining system 216 of FIG. 17 in an engaged state with the tensioning cord 14 and the pull cord 64 not shown for clarity. The anchor 219 has an outer wall 270 and an inner wall 271. The outer wall 270 extends to an outer edge 272 that defines an outer extent of the notch 227. The wedge 221 has an outer wall 274 and an inner wall 275. The outer wall 274 is flush with the outer wall 270 of the anchor 219 when the engagement portion 276 of the wedge 221 is in the notch 227 and engaged with the anchor 219. The wedge 221 has a back wall 288 that is generally rounded both from an upper surface 279 of the wedge 221 to a lower surface 282 of the wedge 221 (see FIG. 27) and from the inner wall 275 to the outer wall 274 (see FIG. 21).

Figure 22:
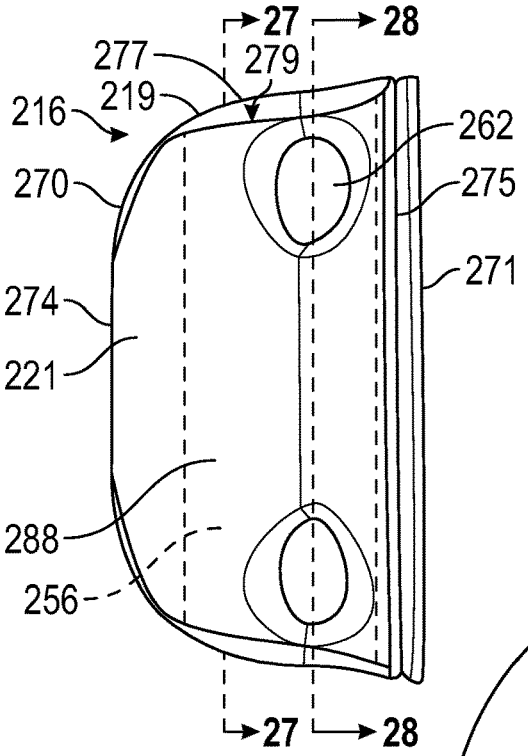
FIG. 22 is a rear view of the wedge and anchor of the tension-retaining system of FIG. 21.

FIG. 22 shows an upper surface 277 of the anchor 219 extending between the inner wall 271 and the outer wall 270. The upper surface 279 of the wedge 221 extends between the inner wall 275 and the outer wall 274. The inner wall 271 of the anchor 219 is between the rear upper portion 218B and the outer wall 270 when the anchor 219 is coupled to the rear upper portion 218B. With reference to FIGS. 20-21, the inner wall 275 of the wedge 221 is between the inner wall 271 of the anchor 219 and the outer wall 274 of the wedge 221 when the wedge 221 is in the notch 227. The inner wall 275 seats against an outer surface 273 of the inner wall 271 (see FIG. 23) when the engagement portion 276 of the wedge 21 is in the notch 227. The inner wall 275 and the inner wall 271 are both relatively planar where the inner wall 275 seats against the inner wall 271. The inner wall 271 of the anchor 219, shown in FIG. 24, is directly coupled to the rear upper portion 220B as in FIG. 17.

Figure 23:
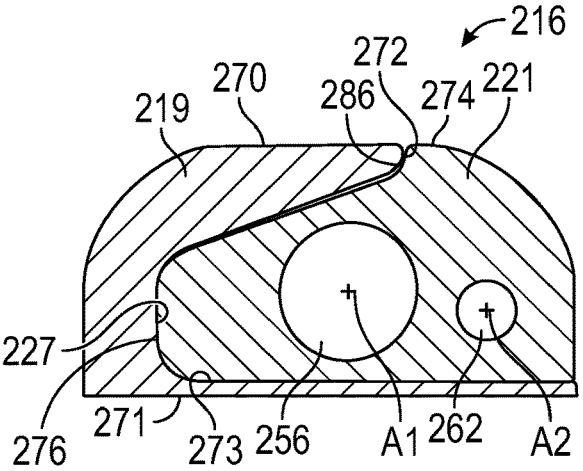
FIG. 23 is a cross-sectional view of the wedge and anchor of the tension-retaining system of FIG. 17 taken at lines 23-23 in FIG. 21.
Figure 24:
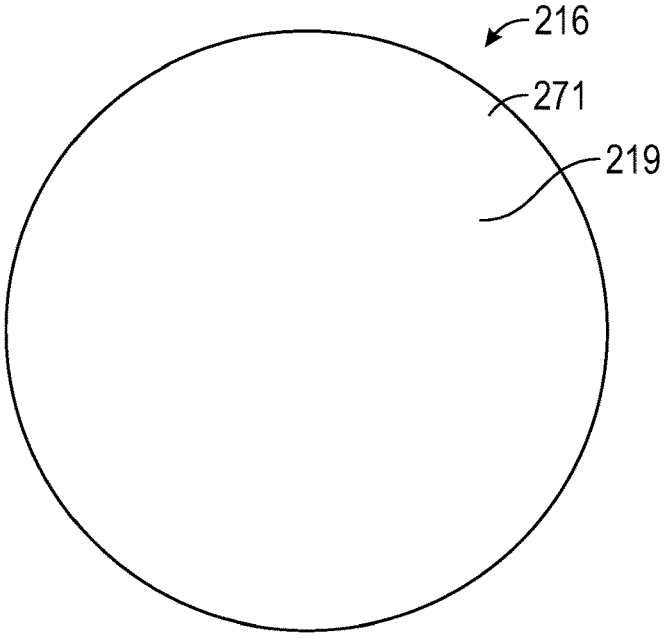
FIG. 24 is a side view of an inner side of the tension-retaining system of FIG. 17.

FIG. 23 shows that the wedge 219 has a lip 286 in the outer wall 274 that fits to and engages the outer edge 272 of the outer wall 270 of the anchor 219. The biasing force of the tensioning cord 14 in combination with the outer edge 272 extending further back than and partially wrapping around the engagement portion 276 will help to prevent the wedge 221 from slipping out of the notch 227 during wear of the footwear 210. Additionally, to release the tensioning system 216, when a rearward and outward force is applied to the pull cord 64 disposed in the pull cord passage 262, the lip 286 of the wedge 221 will pivot against the outer edge 272 and the back wall 288 of the wedge 221 will tip away from the inner wall 271 of the anchor 219, the outer edge 272 providing leverage for the lip 286 rolling outward along the outer edge 272, assisting the user in pulling the wedge 221 out of the notch 227.

Figure 25:
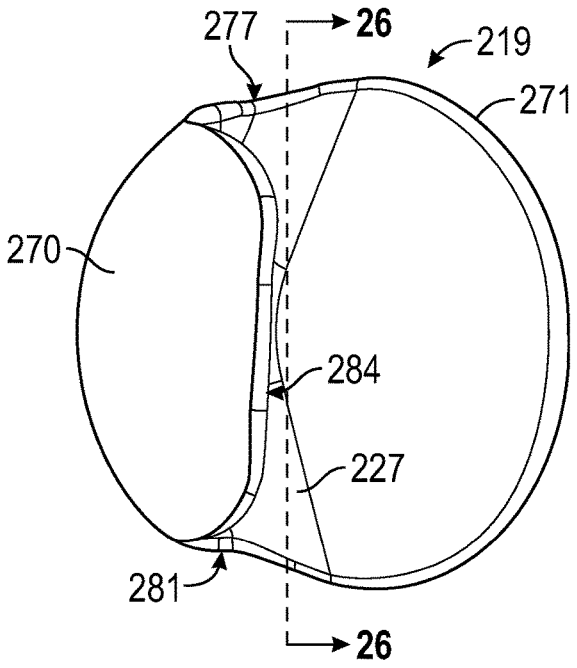
FIG. 25 is a perspective view of the anchor of the tension-retaining system of FIG. 17 showing the notch in the anchor.
Figure 26:
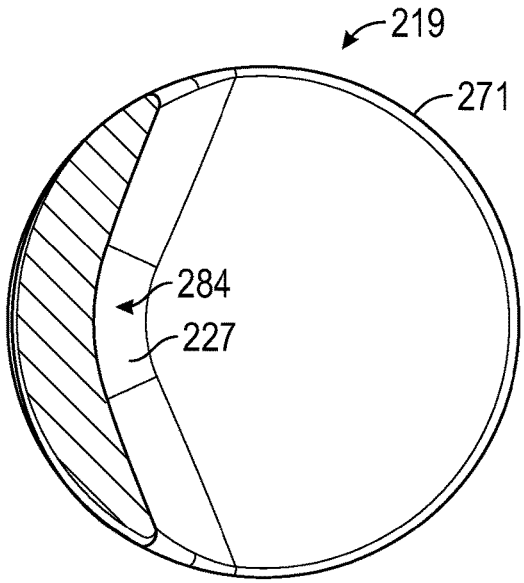
FIG. 26 is a cross-sectional view of the anchor of FIG. 17 taken at lines 26-26 in FIG. 25.
Figure 27:
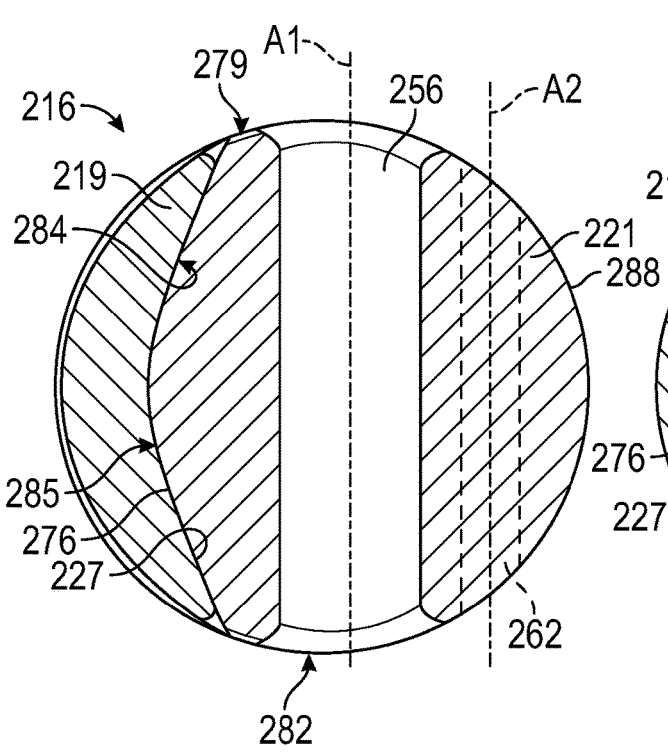
FIG. 27 is a cross-sectional view of the wedge and anchor of the tension-retaining system of FIG. 17 taken at lines 27-27 in FIG. 22.

FIG. 25 is a perspective view of the anchor 219 of the tension-retaining system 216 of FIG. 17 showing the notch 227 in the anchor 219. The anchor 219 has a concave engagement surface 284 in the notch 227. The concave engagement surface 284 is concave in two directions: in a direction from the inner wall 271 to the outer wall 270 of the anchor 219, and in a direction from the upper surface 277 to the lower surface 281 of the anchor 219. As shown in FIG. 27, the engagement portion 276 of the wedge 221 has a convex engagement surface 285 that abuts the concave engagement surface 284 of the anchor 219 when the engagement portion 276 of the wedge 221 is in the notch 227. As best shown in FIGS. 20 and 27, the convex engagement surface 285 is convex in two directions: in a direction from the upper surface 279 to the lower surface 282 of the wedge 221, and in a direction from the inner wall 275 to the outer wall 274 of the wedge 221. The concave engagement surface 284 extends away from the engagement portion 276 of the wedge 221. The concave engagement surface 284 and the convex engagement surface 285 are thus configured to automatically center the wedge 221 to the anchor 219 during engagement and distribute force associated with the tension of the tensioning cord 14 biasing the wedge 221 against the anchor 219 in the notch 227 over a relatively large surface area. Stated differently, the surface areas of the concave engagement surface 284 and the convex engagement surface 285 are larger than if the engagement surfaces of the wedge 221 and the anchor 219 were planar, and/or were not concave or convex in either of the two directions in which the surface 284 and 285 are concave and convex, respectively.

Figure 28:
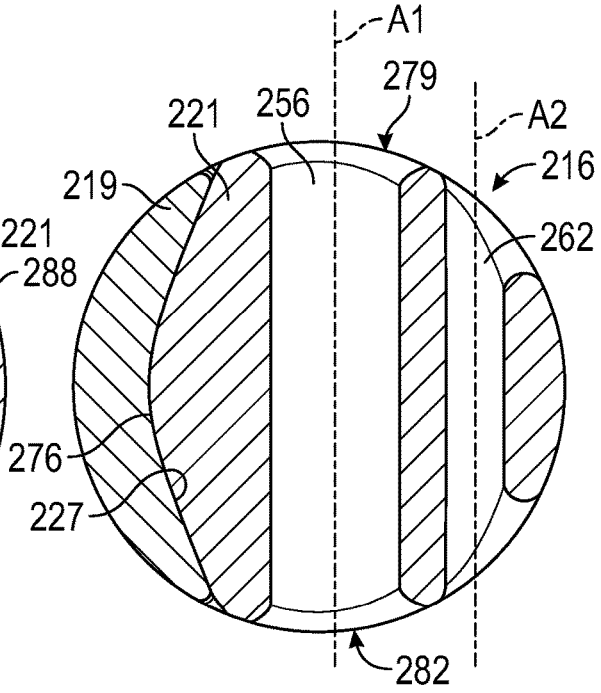
FIG. 28 is a cross-sectional view of the wedge and anchor of the tension-retaining system of FIG. 22 taken at lines 28-28 in FIG. 22.

FIG. 28 best shows that both the tensioning cord passage 256 and the pull cord passage 262 extend through the wedge 221 from the upper surface 279 to the lower surface 282 as through holes. Additionally, the tensioning cord passage 256 and the pull cord passage 262 are straight, cylindrical passages and are non-intersecting (e.g., they do not intersect with one another). The longitudinal center axis A1 of the tensioning cord passage 256 and the longitudinal center axis A2 of the pull cord passage 262 are parallel with one another.

Figure 29:
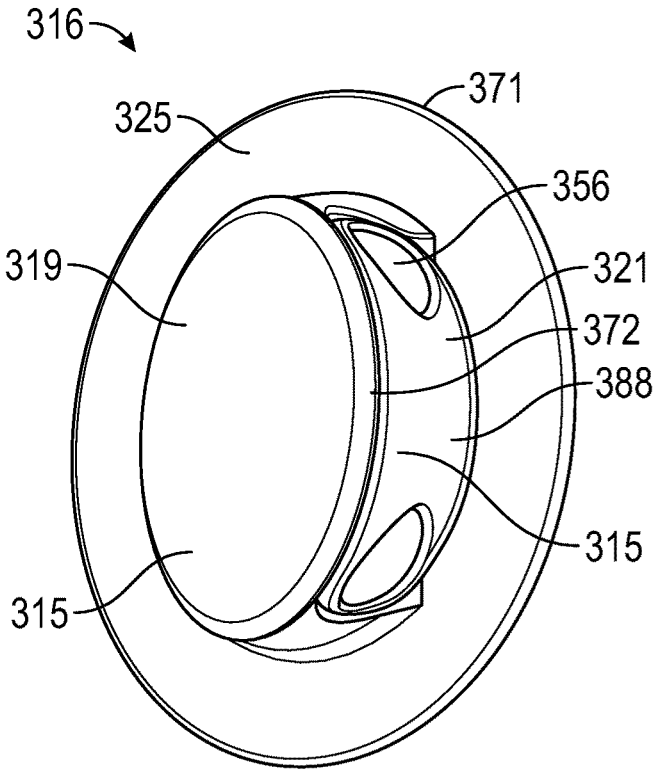
FIG. 29 is a perspective view of an outer side of an alternative tension-retaining system in an engaged state.

FIG. 29 is a perspective view of an outer side of an alternative tension-retaining system 316 in an engaged state. The tension-retaining system 316 may be used for retaining tension in a cord used to tighten a wearable article, such as in place of the tension-retaining systems shown on any of the articles of footwear 10, 110, or 210. The tensioning-retaining system 316 includes a retainer 315 that includes an anchor 319 and a wedge 321. The anchor 319 may be coupled to the rear upper portion 18B or 218B shown herein. The anchor 319 defines a notch 327 (see FIG. 31) and has an outer wall 370 and an inner wall 371. The outer wall 370 extends to an outer edge 372 (see FIG. 30) that defines an outer extent of the notch 327. The wedge 321 has a tensioning cord coupling feature 356 that couples the tensioning cord 14 to the wedge 321. In the embodiment shown, the tensioning cord coupling feature 356 is a tensioning cord passage 356 that is a through hole in the wedge 321 and through which the tensioning cord 14 of FIG. 1 may pass. In other embodiments, the tensioning cord coupling feature 356 could be adhesive or a fastener, such as a pin, that couples the tensioning cord 14 to the wedge 321. The tensioning cord 14 is not shown for clarity. The rear wall 388 of the wedge 321 is arcuate, e.g., shaped as a segment of a circle. The wedge 321 does not include a pull cord coupling feature, such as the pull cord passage 62 described with respect to wedge 21. The absence of a pull cord passage enables the rear wall 388 of the wedge 321 to be substantially flush with an outer edge 372 of the anchor 319, as shown in a top view in FIG. 30, rather than rearward of an outer edge of the anchor 319. Stated differently, in such embodiments, the wedge 321 need not be sized to extend rearward of the outer edge 372 to fit a pull cord passage. When a convex surface 385 of an engagement portion 376 of the wedge 321 is received within the notch 327 of the anchor 319 in order to retain tension in a tensioning cord extending through the tensioning cord passage 356, the convex engagement surface 385 rests against a concave engagement surface 384 of the anchor 319. The notch 327 extends from an upper surface 377 to a lower surface 381 of the anchor 319, which is shown in a rear view in FIG. 31 without the wedge 321 in the notch 327. The biasing force of a tensioning cord in the passage 356 in combination with the outer edge 372 extending back to the rear wall 388 and wrapping around the entire outer side of the engagement portion 376 will help to prevent the wedge 321 from slipping out of the notch 327.

Figure 32:
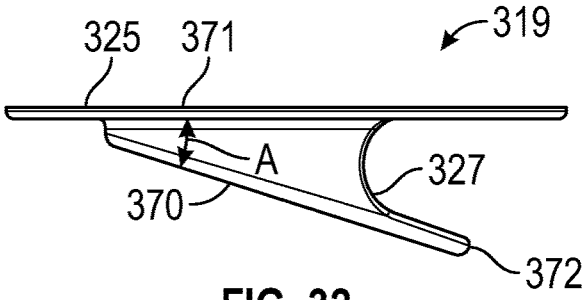
FIG. 32 is a top view of the anchor of FIG. 31.
Figure 33:
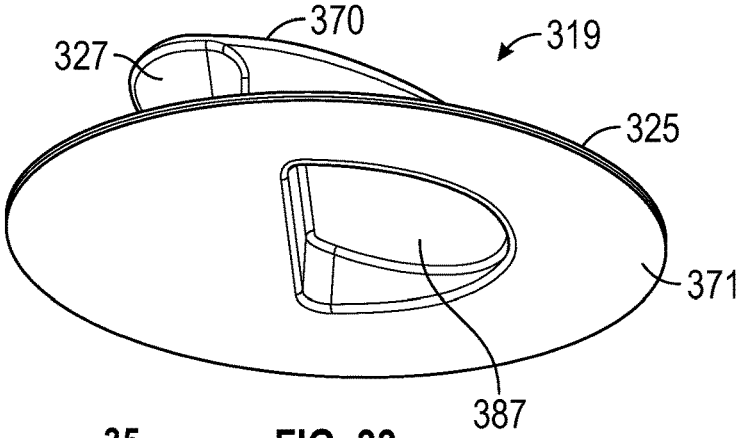
FIG. 33 is a perspective view of an inner side of the anchor of FIG. 31.

The anchor 319 includes a base 325 establishing an inner wall 371 of the anchor 319, and an outer wall 370 diverging from the base 325 at an acute angle A shown in the top perspective view of FIG. 32. FIG. 33 is a perspective view of an inner side of an anchor 319 of the tension-retaining system 316. The inner wall 371 is shown having a recess 387 where the outer wall 370 angles outward from the base 325. The recess 387 helps to reduce the weight and material used for the anchor 319 in comparison to an anchor without a recess in the location shown.

Figure 34:
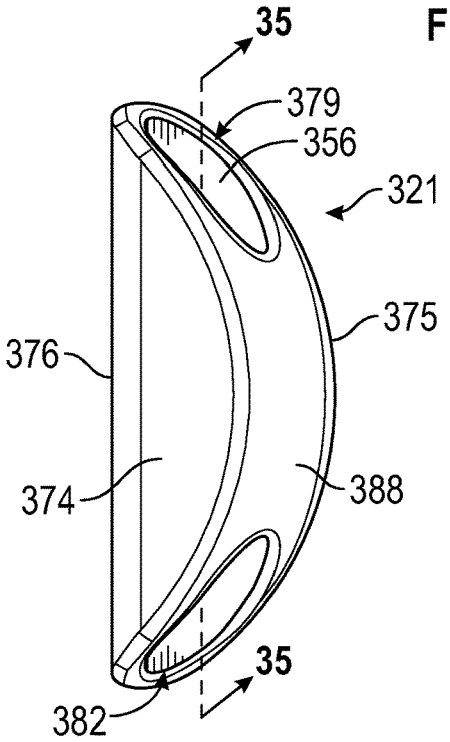
FIG. 34 is a perspective view of the outer side of a wedge of the tension-retaining system of FIG. 29.
Figure 35:
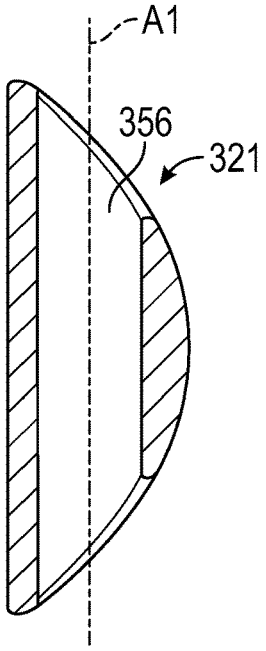
FIG. 35 is a cross-sectional view of the wedge of FIG. 34 taken at lines 35-35 in FIG. 34.
Figure 36:
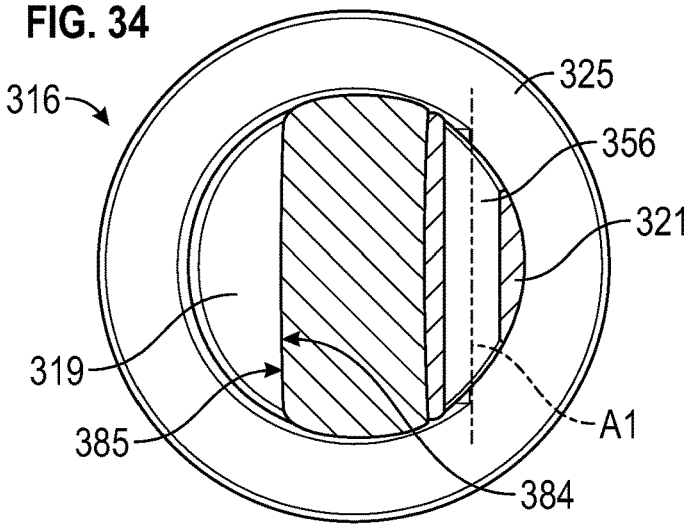
FIG. 36 is a cross-sectional view of the tension-retaining system of FIG. 30 taken at lines 36-36 in FIG. 30.

As shown in FIG. 34, the wedge 321 has an outer wall 374 and an inner wall 375. The outer wall 374 is entirely covered by the outer wall 370 of the anchor 319 when the engagement portion 376 of the wedge 321 is in the notch 327 and engaged with the anchor 319. The tensioning cord passage 356 extends entirely through the wedge 321 as a through hole between the outer wall 374 and the inner wall 375 as shown in FIG. 34. As best shown in FIG. 35, the tensioning cord passage 356 is a straight, cylindrical passage with a longitudinal center axis A1.

Figure 31:
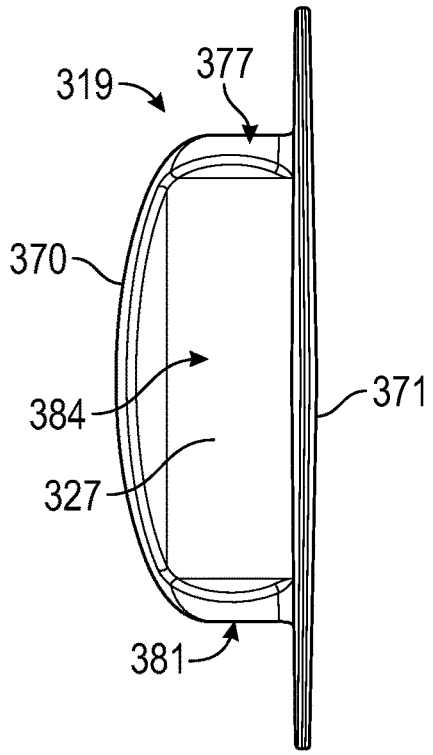
FIG. 31 is a rear view of an anchor of the tension-retaining system of FIG. 29.
Figure 30:
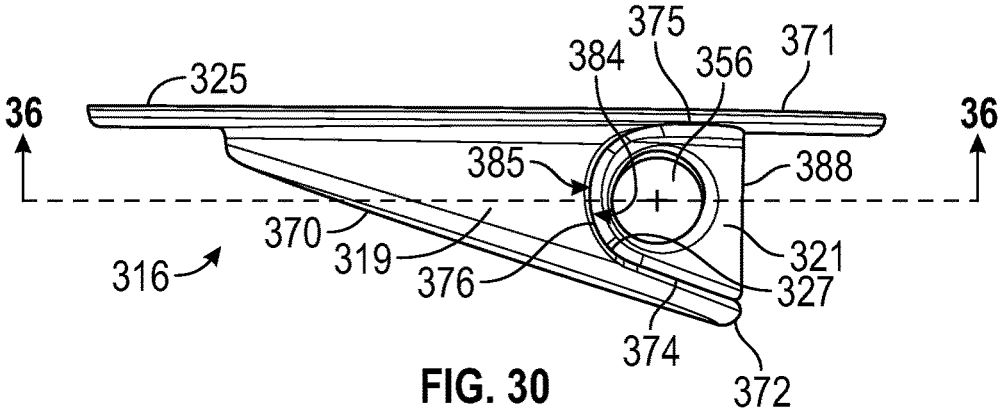
FIG. 30 is a top view of the tension-retaining system of FIG. 29.

FIG. 31 shows an upper surface 377 of the anchor 319 extending between the inner wall 371 and the outer wall 370. An upper surface 379 of the wedge 321 extends between the inner wall 375 and the outer wall 374, and a lower surface 382 of the wedge 321 extends between the inner wall 375 and the outer wall 374, as shown in FIG. 34. The inner wall 371 of the anchor 319 is between the rear upper portion 18B or 218B and the outer wall 370 when the anchor 319 is coupled to the rear upper portion 18B or 218B. The inner wall 371 of the anchor 319 may be directly secured to the rear upper portion 18B or 218B. As shown in FIG. 30, the inner wall 375 of the wedge 321 is between the inner wall 371 of the anchor 319 and the outer wall 374 of the wedge 321 when the wedge 321 is in the notch 327. The inner wall 375 seats against an outer surface of the inner wall 371 when the engagement portion 376 of the wedge 321 is in the notch 327. The inner wall 375 and the inner wall 371 are both relatively planar where the inner wall 375 seats against the inner wall 371.

Figure 37:
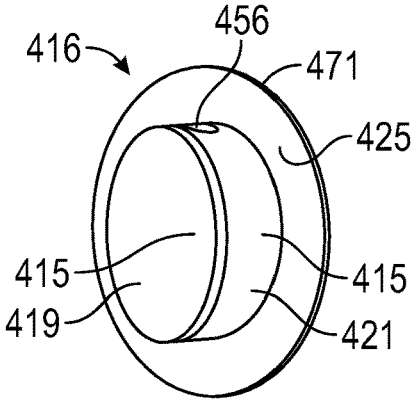
FIG. 37 is a perspective view of an outer side of an alternative tension-retaining system in an engaged state.
Figure 38:
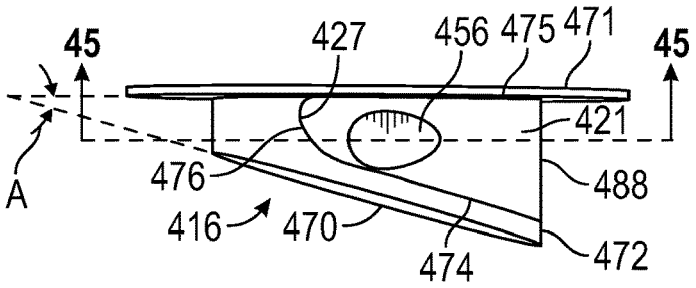
FIG. 38 is a top view of the tension-retaining system of FIG. 37.

FIG. 37 is a perspective view of an outer side of an alternative tension-retaining system 416 in an engaged state. The tension-retaining system 416 may be used for retaining tension in a cord used to tighten a wearable article, such as in place of the tension-retaining systems shown on any of the articles of footwear 10, 110, or 210. The tensioning-retaining system 416 includes a retainer 415 that includes an anchor 419 and a wedge 421. The anchor 419 may be coupled to the rear upper portion 18B or 218B shown herein. As shown in FIG. 38, the anchor 419 defines a notch 427 and has an outer wall 470 and an inner wall 471. The outer wall 470 extends to an outer edge 472 that defines an outer extent of the notch 427. The wedge 421 has a tensioning cord coupling feature 456. In the embodiment shown, the tensioning cord coupling feature 456 is a tensioning cord passage 456 which extends through the wedge 221 as a through hole and through which the tensioning cord 14 passes. In other embodiments, the tensioning cord coupling feature 456 could be adhesive or a fastener, such as a pin, that couples the tensioning cord 14 to the wedge 421. The tensioning cord 14 is not shown for clarity. The wedge 421 does not include a pull cord passage. This enables the rear wall 488 of the wedge 421 to be substantially flush with the outer edge 472 of the anchor 419 as shown in the top view of FIG. 38 when an engagement portion 476 of the wedge 421 is received within the notch 427 of the anchor 419 in order to retain tension in a tensioning cord extending through the tensioning cord passage 456. Stated differently, the wedge 421 need not be sized to extend rearward of the outer edge 472 to fit a pull cord passage. The notch 427 extends from an upper surface 477 to a lower surface 481 of the anchor 419, which is shown in different perspective views in FIGS. 39 and 40 without the wedge 421 in the notch 427. The anchor 419 includes a base 425 establishing the inner wall 471 of the anchor 419, and the outer wall 470 diverges from the base 425 at an acute angle A shown in the top view of FIG. 38.

Figure 39:
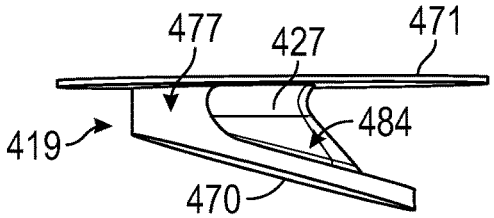
FIG. 39 is a top view of an anchor of the tension-retaining system of FIG. 37.
Figure 40:
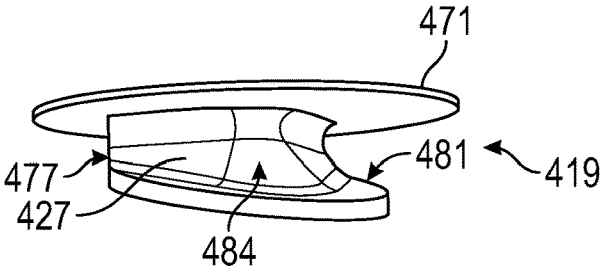
FIG. 40 is a perspective view of the anchor of FIG. 39.
Figure 45:
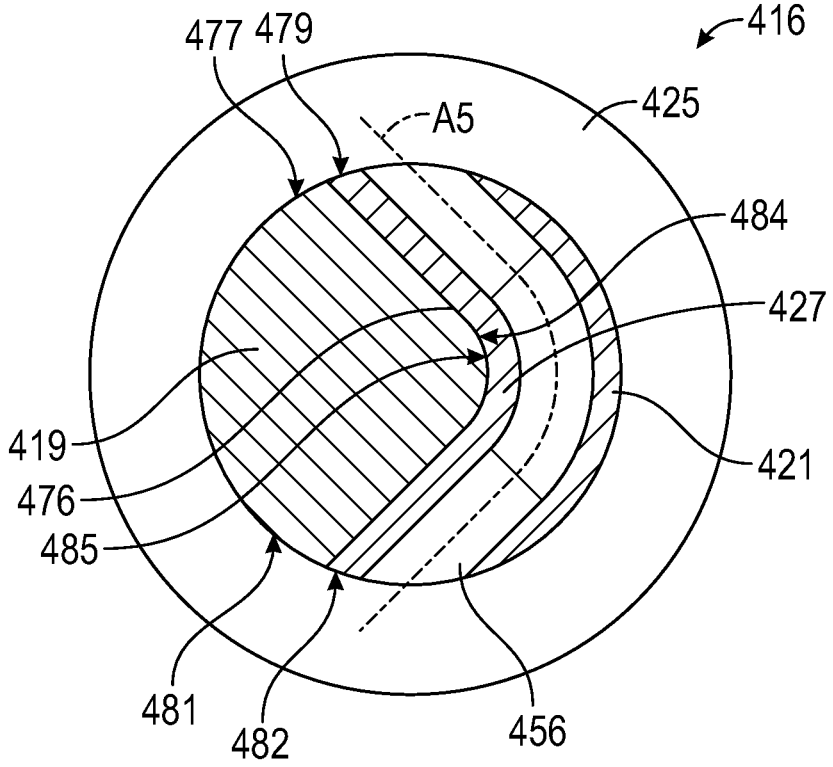
FIG. 45 is a cross-sectional view of the tension-retaining system of FIG. 37 taken at lines 45-45 in FIG. 38.

As best illustrated in FIGS. 39 and 40, the anchor 419 has an engagement surface 484 in the notch 427 that extends toward the engagement portion 476 of the wedge 321 as shown in FIG. 45. The engagement surface 484 in the notch 427 is convex in a direction from the upper surface 477 of the anchor 419 to the lower surface 481 of the anchor 419 as shown in FIGS. 40 and 45. In a direction from the inner wall 471 to the outer wall 470, the engagement surface 484 is concave, as best shown in FIG. 39.

Figure 41:
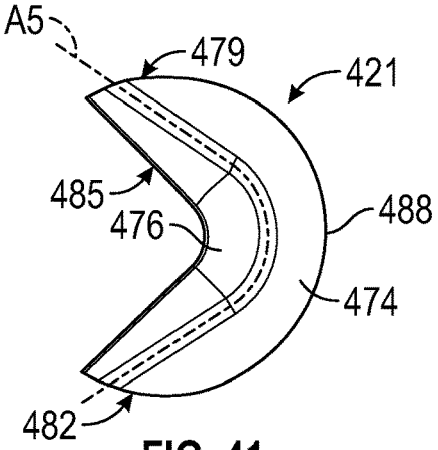
FIG. 41 is a side view of an outer side of a wedge of the tension-retaining system of FIG. 37.

FIG. 41 is a side view of an outer side of the wedge 421 showing an outer wall 474. The engagement surface 485 of the engagement portion 476 is concave in a direction from the upper surface 479 to the lower surface 482 of the wedge 421. As best indicated by the combined views of FIGS. 42-44, the surface 485 of the engagement portion 476 is convex in a direction from the inner wall 475 to the outer wall 474. Additionally, the rear wall 488 is shaped as a segment of a circle (e.g., is arcuate). The cord passage 456 extends completely through the wedge 421 from the upper surface 479 to the lower surface 482 as a through hole and is arcuate, generally following the shape of the concave surface 485 in that direction. A longitudinal center axis A5 of the cord passage 456 is shown in FIGS. 41 and 43-45.

As best shown in FIG. 45, the engagement surface 485 of the engagement portion 476 of the wedge 421 abuts and is biased against the engagement surface 484 of the anchor 419 when the engagement portion 476 of the wedge 421 is in the notch 427 and the tensioning cord 14 (not shown) extends through the cord passage 456. The concavity of the engagement surface 484 of the wedge 421 in the direction from the upper surface 479 to the lower surface 482 matches the convexity of the engagement surface 485 of the anchor 419 from the upper surface 477 to the lower surface 481. Additionally, the convexity of the engagement surface 485 of the wedge 421 in the direction from the inner wall 475 to the outer wall 474 matches the concavity of the engagement surface 484 of the anchor 419 from the inner wall 471 to the outer wall 470. The engagement surface 484 and the engagement surface 485 are thus configured to automatically center the wedge 421 to the anchor 419 during engagement and distribute force associated with the tension of the tensioning cord biasing the wedge 421 against the anchor 419 in the notch 427 over a relatively large surface area. The surface areas of the engagement surfaces 484 and 485 are larger than if the engagement surfaces of the wedge 421 and the anchor 419 were planar, and were not concave or convex in either of the two directions in which the surfaces 484 and 485 are concave or convex, as described.

Figure 42:
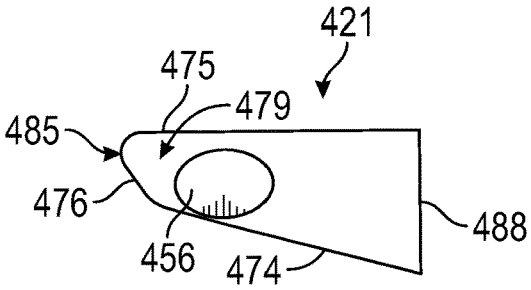
FIG. 42 is a top view of the wedge of FIG. 41.
Figure 43:
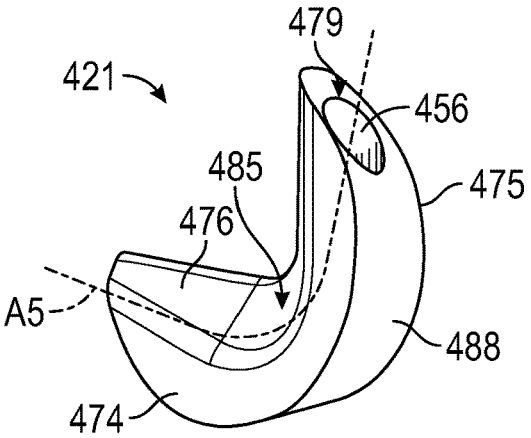
FIG. 43 is a perspective view of the outer side and a rear of the wedge of FIG. 41.
Figure 44:
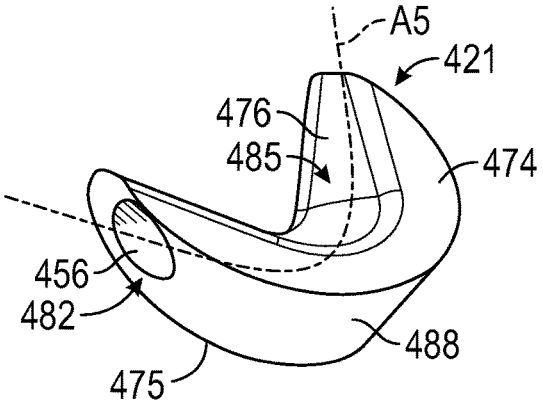
FIG. 44 is another perspective view of the outer side and the rear of the wedge of FIG. 41.

FIG. 39 shows the upper surface 477 of the anchor 419 extending between the inner wall 471 and the outer wall 470. The upper surface 479 of the wedge 421 extends between the inner wall 475 and the outer wall 474 as shown in FIGS. 42 and 43. The inner wall 471 of the anchor 419 is between the rear upper portion 18B or 218B and the outer wall 470 when the anchor 419 is coupled to the rear upper portion 18B or 218B. The inner wall 471 of the anchor 419 may be directly secured to the rear upper portion 18B or 218B. As shown in FIG. 38, the inner wall 475 of the wedge 421 is between the inner wall 471 of the anchor 419 and the outer wall 474 of the wedge 421 when the wedge 421 is in the notch 427. The inner wall 475 seats against an outer surface of the inner wall 471 when the engagement portion 476 of the wedge 421 is in the notch 427. The inner wall 475 and the inner wall 471 are both relatively planar where the inner wall 475 seats against the inner wall 471.

Figure 46:
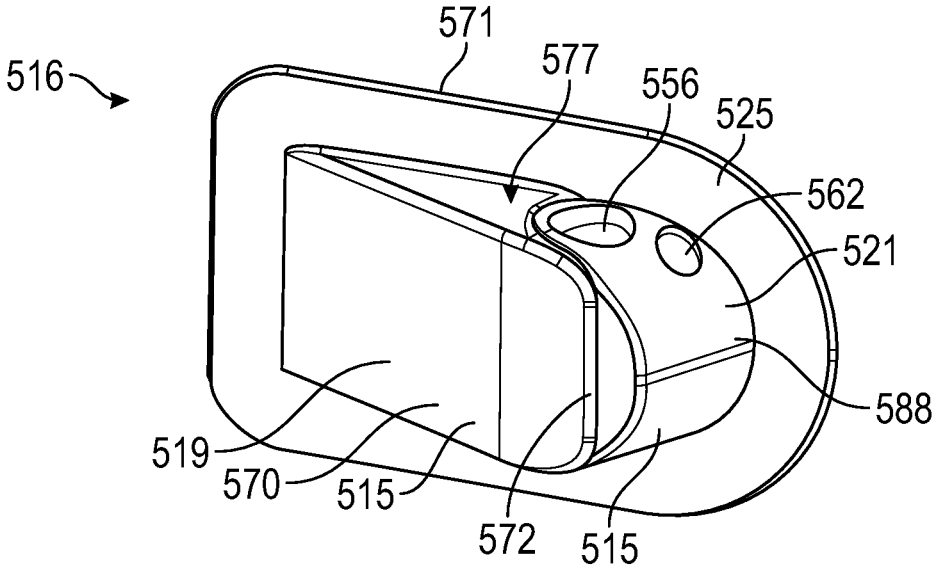
FIG. 46 is a perspective view of an outer side of an alternative tension-retaining system in an engaged state.
Figure 47:
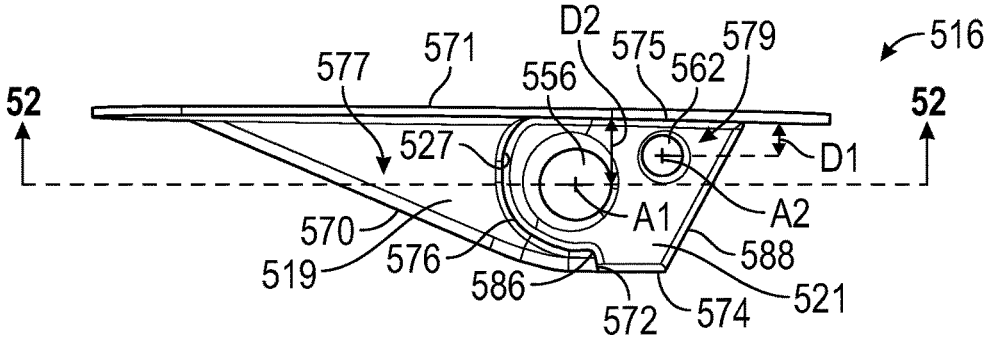
FIG. 47 is a top view of the tension-retaining system of FIG. 46.
Figure 48:
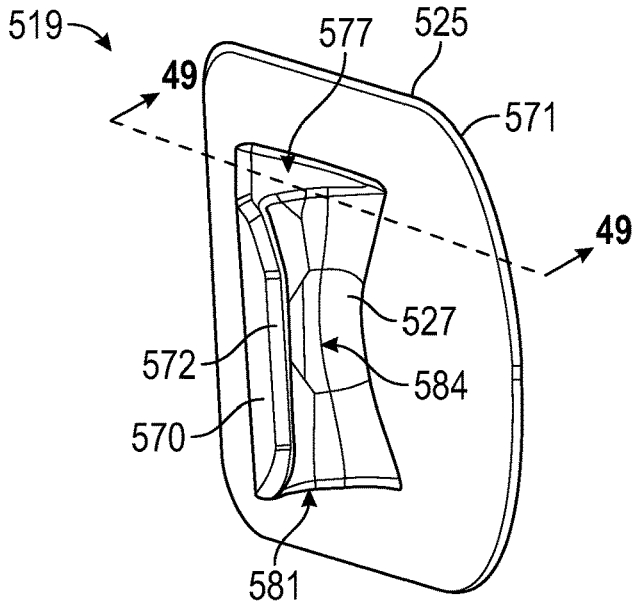
FIG. 48 is a perspective view of an anchor of the tension-retaining system of FIG. 46.
Figure 49:
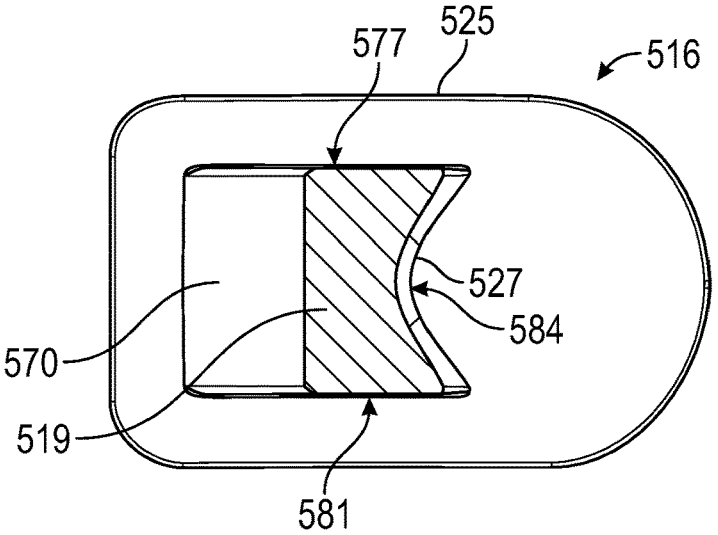
FIG. 49 is a cross-sectional view of the anchor of FIG. 48 taken at lines 49-49 in FIG. 48.

FIG. 46 is a perspective view of an outer side of an alternative tension-retaining system 516 in an engaged state. The tension-retaining system 516 may be used for retaining tension in a cord used to tighten a wearable article, such as in place of the tension-retaining systems shown on any of the articles of footwear 10, 110, or 210. The tensioning-retaining system 516 includes a retainer 515 that includes an anchor 519 and a wedge 521. The anchor 519 may be coupled to the rear upper portion 18B or 218B shown herein. As shown in FIG. 47, the anchor 519 defines a notch 527 and has an outer wall 570 and an inner wall 571. The outer wall 570 extends to an outer edge 572 that defines an outer extent of the notch 527. The notch 527 extends from an upper surface 577 to a lower surface 581 of the anchor 519, which is shown in FIGS. 48 and 49 without the wedge 521 in the notch 527. The anchor 519 includes a base 525 establishing the inner wall 571 of the anchor 419, and the outer wall 570 diverging from the base 525 at an acute angle A shown in the top view of FIG. 47. The lower surface 581 and the upper surface 577 of the anchor 19 extend between the inner wall 571 and the outer wall 570.

Figure 51:
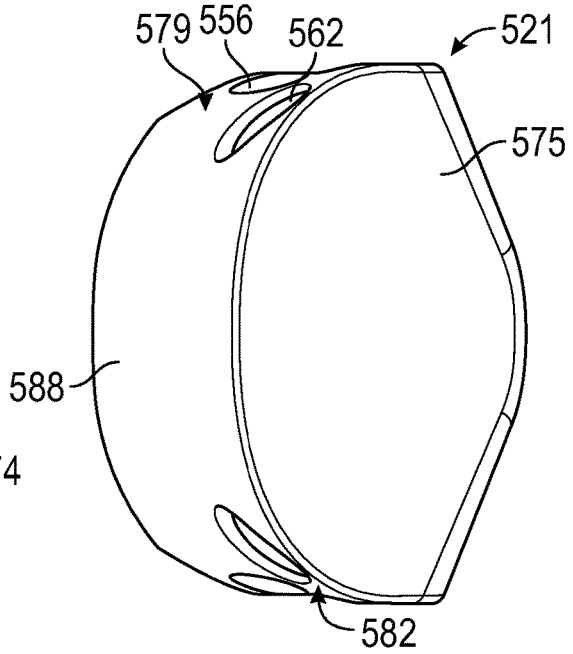
FIG. 51 is a perspective view of an inner side of the wedge of FIG. 50.
Figure 52:
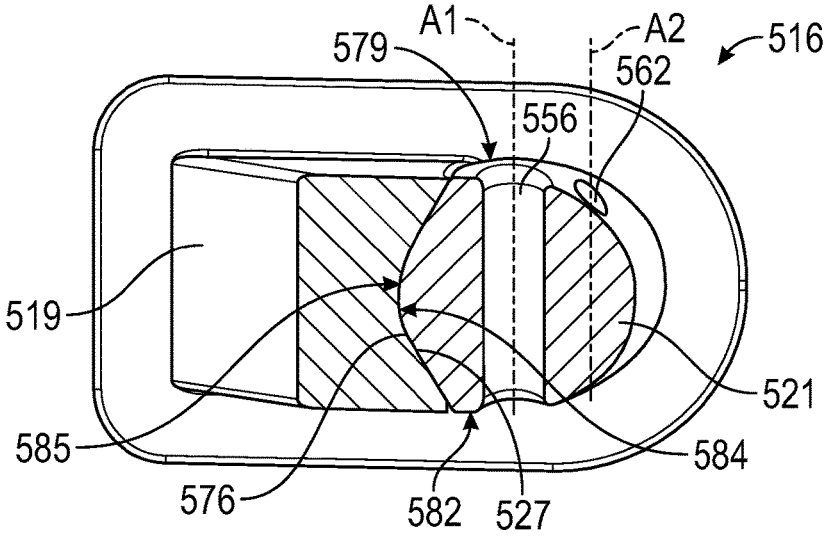
FIG. 52 is a cross-sectional view of the tension-retaining system of FIG. 46 taken at lines 52-52 in FIG. 47.

An engagement portion 576 of the wedge 521 is received within the notch 527 of the anchor 519 in order to retain tension in a tensioning cord (not shown) extending through a tensioning cord coupling feature 556 of the wedge 521. In the embodiment shown, the tensioning cord coupling feature 556 is a tensioning cord passage 556. The wedge 521 also has a pull cord coupling feature 562. The pull cord coupling feature 562 is a pull cord passage 562. In other embodiments, either or both of the tensioning cord coupling feature 556 and the pull cord coupling feature 562 could be adhesive or a fastener, such as a pin, that couples the tensioning cord 14 to the wedge 521 and the pull cord to the wedge 521, respectively. Both of the passages 556, 562 extend through the wedge 221 as through holes and through which the tensioning cord 14 and the pull cord 64 pass, respectively. The tensioning cord passage 556 extends through the wedge 521 from an upper surface 579 of the wedge 521 to a lower surface 582 of the wedge 521 as a through hole as best shown in FIG. 52. FIGS. 47, 51 and 52 best show that both the tensioning cord passage 556 and the pull cord passage 562 extend through the wedge 521 from the upper surface 579 to the lower surface 582. Additionally, the tensioning cord passage 556 and the pull cord passage 562 are straight, cylindrical passages and are non-intersecting (e.g., they do not intersect with one another). A longitudinal center axis A1 of the tensioning cord passage 556 and a longitudinal center axis A2 of the pull cord passage 562 are parallel with one another. The lower surface 582 and the upper surface 579 of the wedge 521 extend between the inner wall 575 and the outer wall 574 of the wedge 521.

Referring to FIG. 47, the longitudinal center axis A2 of the pull cord passage 562 is a first distance D1 from the inner wall 575 of the wedge 521, and the longitudinal center axis A1 of the tensioning cord passage 556 is a second distance D2 from the inner wall 575. The second distance D2 is greater than the first distance D1. Due to this differential offset in the axes A1, A2 from the inner wall 575, a tensile force F on a tensioning cord extending through the cord passage 556 created in reaction to a force pulling on a pull cord extending through the pull cord passage 562 will align with the opposing pull cord force when moving the tensioning-retaining system 516 to an engaged state by tipping the wedge 521 inward toward the notch 527 (e.g., the front of the wedge 521 at the engagement portion 576 tips in toward the inner wall 571 in the notch 527) to help align the wedge 521 with the anchor 519, as discussed with respect to the tensioning-retaining system 216 of FIGS. 18-20 and which discussion applies equally to the tension-retaining system 516.

Figure 50:
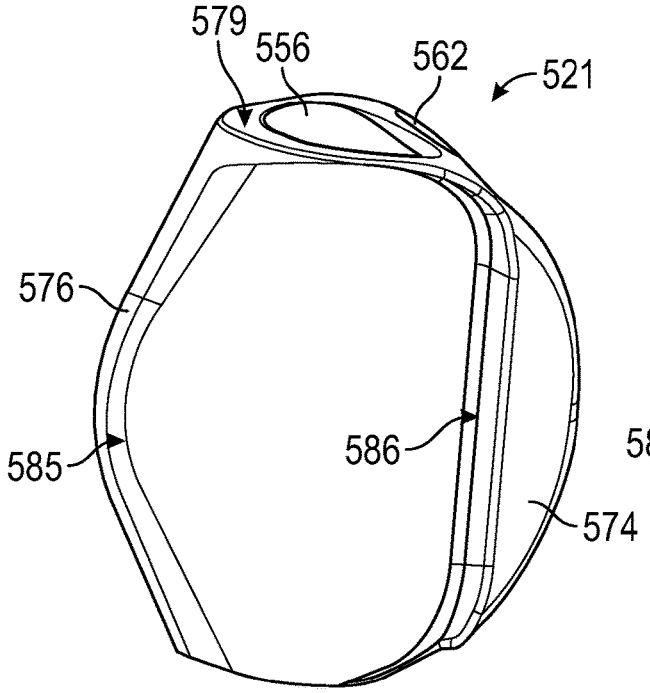
FIG. 50 is a perspective view of an outer side of a wedge of the tension-retaining system of FIG. 46.

In addition to the automatic tip in of the wedge 521, the tension-retaining system 516 has other features configured to ensure quick and accurate engagement of the wedge 521 with the anchor 519. For example, as shown in FIGS. 48-49 and 52, the anchor 519 has a concave engagement surface 584 in the notch 527. The engagement portion 576 of the wedge 521 has a convex engagement surface 585 (best shown in FIG. 50) that abuts the concave engagement surface 584 of the anchor 519 when the engagement portion 576 of the wedge 521 is in the notch 527. The concave engagement surface 584 extends away from the engagement portion 576 of the wedge 521. As best shown in FIGS. 47, 50, and 52, the convex engagement surface 585 is convex in two directions: in a direction from the upper surface 579 to the lower surface 582 of the wedge 521, and in a direction from the inner wall 575 to the outer wall 574 of the wedge 521. As best shown in FIGS. 47-49, the concave engagement surface 584 is likewise concave in two directions: in a direction from the inner wall 571 to the outer wall 570 of the anchor 519, and in a direction from the upper surface 577 to the lower surface 581 of the anchor 519. The concave engagement surface 584 and the convex engagement surface 585 are thus configured to automatically center the wedge 521 to the anchor 519 during engagement and distribute force associated with the tension of the tensioning cord biasing the wedge 521 against the anchor 519 in the notch 527 over a relatively large surface area. Stated differently, the surface areas of the concave engagement surface 584 and the convex engagement surface 585 are larger than if the engagement surfaces of the wedge 521 and the anchor 519 were planar, and/or were not concave or convex in either of the two directions in which the surface 584 and 585 are concave and convex, respectively.

Similar to the lip 86 and outer edge 72 of the tension-retaining system 16, the wedge 521 has a lip 586 in the outer wall 574 of the wedge 521 that fits to and engages the outer edge 572 of the outer wall 570 of the anchor 519. The concave shape of the engagement surface 584 of the notch 527 inward of the outer edge 572 and the convex shape of the engagement surface 585 of the engagement portion 576 ensures that the engagement portion 576 extends past the outer edge 572 in the notch 527. The biasing force of a tensioning cord in the cord passage 556 in combination with the outer edge 572 extending further back than and partially wrapping around the engagement portion 576 will help to prevent the wedge 521 from slipping out of the notch 527 during wear of the footwear having the tension-retaining system 516 until the wedge 521 is intentionally manually removed from the notch 527.

FIG. 47 shows the upper surface 577 of the anchor 519 extending between the inner wall 571 and the outer wall 570. The upper surface 579 of the wedge 521 extends between the inner wall 575 and the outer wall 574. The inner wall 571 of the anchor 519 is between the rear upper portion 18B or 218B and the outer wall 570 when the anchor 519 is coupled to the rear upper portion 18B or 218B. The inner wall 571 of the anchor 519 may be directly coupled to the rear upper portion 18B or 218B. The inner wall 575 of the wedge 521 is between the inner wall 571 of the anchor 519 and the outer wall 574 of the wedge 521 when the wedge 521 is in the notch 527. The inner wall 575 seats against an outer surface of the inner wall 571 when the engagement portion 576 of the wedge 521 is in the notch 527. The inner wall 575 and the inner wall 571 are both relatively planar where the inner wall 575 seats against the inner wall 571. The wedge 521 has a back wall 588 that is generally rounded from the upper surface 579 to the lower surface 582.

Figure 53:
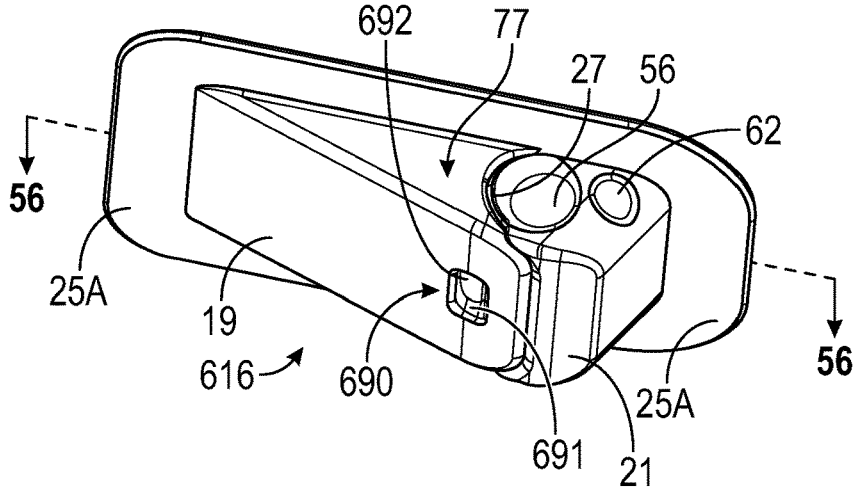
FIG. 53 is a perspective view of an outer side of an alternative tension-retaining system in an engaged state.

FIG. 53 is a perspective view of an outer side of an alternative tension-retaining system 616 in an engaged state. The tension-retaining system 616 includes the anchor 19 and the wedge 21 including all of the features of these components and the tension-retaining system 16 as shown and described with respect to FIGS. 1-14. In addition to those features, the tension-retaining system 616 includes a holding mechanism 690 holding the wedge 21 in the notch 27 when the engagement portion 76 of the wedge 21 is fit within the notch 27. The holding mechanism 690 includes a first holding component 691 disposed on the anchor 19 and a second holding component 692 disposed on the wedge 21 and interfitting with the first holding component 691. In the embodiment shown, the holding mechanism 691 may be referred to as a snap or a frictional fit mechanism. The first holding component 691 is a socket (e.g., an aperture) in the outer wall 70 of the body 19 that extends through the outer wall to the notch 27, and is referred to as socket 691. The first holding component 691 may also be referred to as a contoured surface, as the aperture through the outer wall 70 creates a contoured surface of the outer wall 70 at the aperture.

Figure 54:
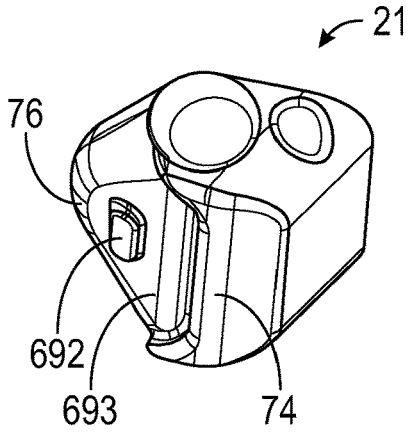
FIG. 54 is a perspective view of an outer side of a wedge of the tension-retaining system of FIG. 53.
Figure 55:
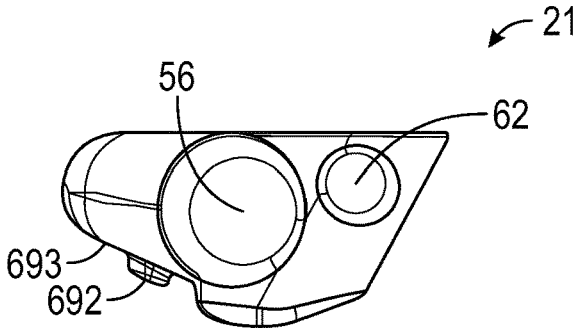
FIG. 55 is a top view of the wedge of FIG. 53.
Figure 56:
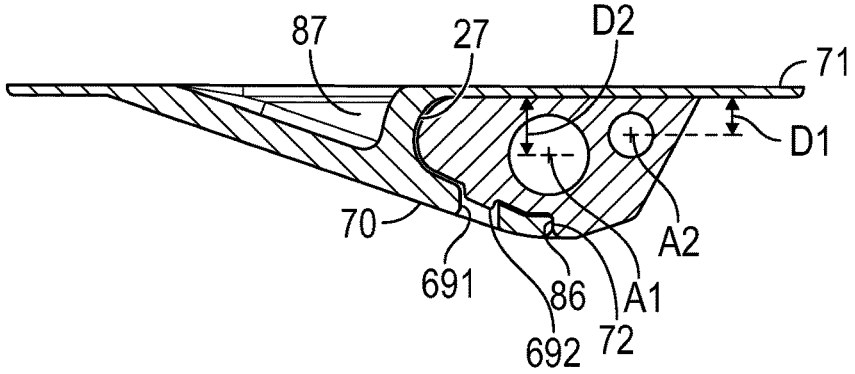
FIG. 56 is a cross-sectional view of the tension-retaining system of FIG. 53 taken at lines 56-56 in FIG. 53.

The second holding component 692 is a stud that extends outward from the engagement portion 76 of the wedge 21 and is referred to as stud 692 or a detent. FIG. 54 is a perspective view of an outer side 693 of the wedge 21 and FIG. 55 is a top view of the wedge of FIG. 53 both showing the stud 692 protruding outward from the wedge 21. In the embodiment shown, the stud 692 is integral with and is a unitary, one-piece component with the wedge 21. In other embodiments, the stud 692 may be a component that is distinct from and secured integrally to the wedge 21, such as by adhering, thermal bonding, etc. The socket 691 is sized so that the stud 692 snaps within the socket 691 and is held to the body 19 by a friction fit of the stud 692 to the body 19. Accordingly, the holding mechanism 690 is a frictional fit mechanism. As is evident in the cross-sectional view of FIG. 56, the interfitting socket 691 and stud 692 are disposed further forward in the notch 27 than the tensioning cord passage 56. Accordingly, the holding mechanism 690 will also help to retain the wedge 21 in the notch 27, even in the absence of any biasing forces of the tensioning cord biasing the wedge 21 into the notch 27, until the wedge 21 is intentionally removed from the notch 27. The material of the body 19 may have some ability to flex to allow the stud 692 to pass under the outer wall 70 and into or out of the socket 691 during insertion and removal. In an alternative embodiment, the stud 692 may be depressible to a position where it is flush with the outer side 693 of the engagement portion 76 of the stud 21. In such an embodiment depression of the stud 692 toward the outer side 693, such as with a pin inserted through the socket 691 or otherwise, will allow it to release from the body 19.

In still other embodiments, the interfitting wedge 21 and notch 27 may be supplemented with a holding mechanism that is magnetic. For example, the body 19 may have a first holding component that includes one of a magnet or a ferromagnetic material, and the wedge 21 may have a second holding component that includes the other of the magnet and the ferromagnetic material, where the magnet is magnetically attractive to the ferromagnetic material. Alternatively, the first holding component may be a first magnet, and the second holding component may be a second magnet, with the first magnet magnetically attractive to the second magnet.

The following Clauses provide example configurations of a tension-retaining system for a wearable article, and of a wearable article.

Clause 1. A tension-retaining system for retaining tension in a tensioning cord of a wearable article, the tension-retaining system comprising: a retainer including: an anchor defining a notch; and a wedge having a tensioning cord coupling feature; wherein the wedge has an engagement portion that fits within the notch with the engagement portion disposed further in the notch than the tensioning cord coupling feature.

Clause 2. The tension-retaining system of clause 1, wherein the wedge defines a pull cord coupling feature; wherein the tensioning cord coupling feature is disposed between the engagement portion and the pull cord coupling feature.

Clause 3. The tension-retaining system of clause 2, wherein: the tensioning cord coupling feature is a tensioning cord passage extending through the wedge; the pull cord coupling feature is a pull cord passage extending through the wedge; and the pull cord passage and the tensioning cord passage are non-intersecting.

Clause 4. The tension-retaining system of clause 3, wherein a longitudinal center axis of the pull cord passage is parallel with a longitudinal center axis of the tensioning cord passage.

Clause 5. The tension-retaining system of any of clauses 3-4, wherein: the wedge has an inner wall, an outer wall, an upper surface between the inner wall and the outer wall, and a lower surface between the inner wall and the outer wall; the inner wall is between the wearable article and the outer wall when the anchor is coupled to the wearable article and the wedge is in the notch; the tensioning cord passage and the pull cord passage extend through the wedge from the upper surface to the lower surface; and a longitudinal center axis of the pull cord passage is a first distance from the inner wall, a longitudinal center axis of the tensioning cord passage is a second distance from the inner wall, and the second distance is greater than the first distance.

Clause 6. The tension-retaining system of any of clauses 3-5, wherein: the anchor has a base; and the wedge has an inner wall that seats against the base when the engagement portion of the wedge is in the notch.

Clause 7. The tension-retaining system of clause 6, wherein: a longitudinal center axis of the pull cord passage is a first distance from the inner wall; a longitudinal center axis of the tensioning cord passage is a second distance from the inner wall; and the second distance is greater than the first distance.

Clause 8. The tension-retaining system of any of clauses 1-7, wherein: the anchor has a base and an outer wall diverging outward from the base; and the outer wall extends to an edge defining an outer extent of the notch.

Clause 9. The tension-retaining system of clause 8, wherein the outer wall diverges outward from the base at an acute angle.

Clause 10. The tension-retaining system of any of clauses 8-9, wherein: the wedge has an outer wall that defines a lip; and the lip engages the edge of the outer wall of the anchor when the engagement portion of the wedge is in the notch.

Clause 11. The tension-retaining system of clause 10, wherein the outer wall of the wedge is flush with the outer wall of the anchor when the engagement portion of the wedge is in the notch.

Clause 12. The tension-retaining system of any of clauses 1-11, wherein: the anchor has a convex engagement surface in the notch, the convex engagement surface extending toward the engagement portion of the wedge; and the engagement portion of the wedge has a concave engagement surface that abuts the convex engagement surface of the anchor when the engagement portion of the wedge is in the notch.

Clause 13. The tension-retaining system of any of clauses 1-11, wherein: the anchor has a concave engagement surface in the notch, the concave engagement surface extending away from the engagement portion of the wedge; and the engagement portion of the wedge has a convex engagement surface that abuts the concave engagement surface of the anchor when the engagement portion of the wedge is in the notch.

Clause 14. The tension-retaining system of any of clauses 1-13, further comprising: a holding mechanism holding the wedge in the notch when the engagement portion of the wedge is fit within the notch, the holding mechanism including a first holding component disposed on the anchor and a second holding component disposed on the wedge and interfitting with the first holding component.

Clause 15. The tension-retaining system of clause 14, wherein the holding mechanism is magnetic, the first holding component includes one of a magnet or a ferromagnetic material, and the second holding component includes the other of the magnet and the ferromagnetic material; and wherein the magnet is magnetically attractive to the ferromagnetic material.

Clause 16. The tension-retaining system of clause 14, wherein the holding mechanism is magnetic, the first holding component includes a first magnet, the second holding component includes a second magnet, and the first magnet is magnetically attractive to the second magnet.

Clause 17. The tension-retaining system of clause 14, wherein the holding mechanism is a snap, the first holding component is one of a socket or a stud that snaps within the socket, and the second holding component is the other of the socket or the stud.

Clause 18. The tension-retaining system of clause 14, wherein the holding mechanism is a frictional fit mechanism, the first holding component is one of a contoured surface or a detent that fits to the contoured surface, and the second holding component is the other of the contoured surface or the detent.

Clause 19. A wearable article comprising: a body at least partially defining an interior cavity; a closure system for tightening the body around the interior cavity, the closure system comprising: a tensioning cord having a proximal portion operatively secured to the body and having a distal portion; and a tension-retaining system that retains tension in the tensioning cord when the distal portion is pulled away from the proximal portion, the tension-retaining system comprising: a retainer including an anchor and a wedge; wherein the anchor is coupled to the body and defines a notch opening away from the proximal portion of the tensioning cord; wherein the wedge defines a tensioning cord coupling feature with the distal portion of the tensioning cord coupled to the wedge at the tensioning cord coupling feature; and wherein the wedge has an engagement portion that fits within the notch with the engagement portion disposed further in the notch than the tensioning cord coupling feature so that tension in the tensioning cord biases the engagement portion of the wedge into the notch.

Clause 20. The wearable article of clause 19, wherein the wedge defines a pull cord coupling feature and the tensioning cord coupling feature is disposed between the engagement portion and the pull cord coupling feature; and the tension-retaining system further comprising: a pull cord coupled to the wedge at the pull cord coupling feature.

Clause 21. The wearable article of clause 20, wherein the closure system further comprises: a first hook-and-loop fastener component coupled to the pull cord and a second hook-and-loop fastener component secured to a surface of the body with the anchor between the proximal portion of the tensioning cord and the second hook-and-loop fastener component; and wherein the first hook-and-loop fastener component releasably engages with the second hook-and-loop fastener component.

Clause 22. The wearable article of clause 20, wherein: the tensioning cord coupling feature is a tensioning cord passage extending through the wedge; the pull cord coupling feature is a pull cord passage extending through the wedge; and a longitudinal center axis of the pull cord passage is parallel with a longitudinal center axis of the tensioning cord passage.

Clause 23. The wearable article of clause 22, wherein: the wedge has an inner wall, an outer wall, an upper surface between the inner wall and the outer wall, and a lower surface between the inner wall and the outer wall; the inner wall is between the body and the outer wall when the wedge is in the notch; the tensioning cord passage and the pull cord passage extend through the wedge from the upper surface to the lower surface; and the longitudinal center axis of the pull cord passage is a first distance from the inner wall, the longitudinal center axis of the tensioning cord passage is a second distance from the inner wall, and the second distance is greater than the first distance.

Clause 24. The wearable article of any of clauses 22-23, wherein the pull cord passage and the tensioning cord passage are non-intersecting.

Clause 25. The wearable article of any of clauses 22-24, wherein: the anchor has a base coupled to the body of the wearable article; and the wedge has an inner wall that seats against the base when the engagement portion of the wedge is in the notch.

Clause 26. The wearable article of clause 25, wherein: the longitudinal center axis of the pull cord passage is a first distance from the inner wall; the longitudinal center axis of the tensioning cord passage is a second distance from the inner wall; and the second distance is greater than the first distance.

Clause 27. The wearable article of any of clauses 21-26, wherein: the anchor has a base coupled to the body of the wearable article and an outer wall diverging outward from the base; and the outer wall extends to an edge defining an outer extent of the notch.

Clause 28. The wearable article of clause 27, wherein the outer wall diverges outward from the base at an acute angle.

Clause 29. The wearable article of any of clauses 27-28, wherein: the wedge has an outer wall that defines a lip; and the lip engages the edge of the outer wall of the anchor when the engagement portion of the wedge is in the notch.

Clause 30. The wearable article of clause 29, wherein the outer wall of the wedge is flush with the outer wall of the anchor when the engagement portion of the wedge is in the notch.

Clause 31. The wearable article of any of clauses 19-30, wherein: the anchor has a convex engagement surface in the notch, the convex engagement surface extending toward the engagement portion of the wedge; and the engagement portion of the wedge has a concave engagement surface that abuts the convex engagement surface of the anchor when the engagement portion of the wedge is in the notch.

Clause 32. The wearable article of any of clauses 19-31, wherein: the anchor has a concave engagement surface in the notch, the concave engagement surface extending away from the engagement portion of the wedge; and the engagement portion of the wedge has a convex engagement surface that abuts the concave engagement surface of the anchor when the engagement portion of the wedge is in the notch.

Clause 33. The wearable article of any of clauses 19-32, further comprising: a holding mechanism holding the wedge in the notch when the engagement portion of the wedge is fit within the notch, the holding mechanism including a first holding component disposed on the anchor and a second holding component disposed on the wedge and interfitting with the first holding component.

Clause 34. The wearable article of clause 33, wherein the holding mechanism is magnetic, the first holding component includes one of a magnet or a ferromagnetic material, and the second holding component includes the other of the magnet and the ferromagnetic material; and wherein the magnet is magnetically attractive to the ferromagnetic material.

Clause 35. The wearable article of clause 33, wherein the holding mechanism is magnetic, the first holding component includes a first magnet, the second holding component includes a second magnet, and the first magnet is magnetically attractive to the second magnet.

Clause 36. The wearable article of clause 33, wherein the holding mechanism is a snap, the first holding component is one of a socket or a stud that snaps within the socket, and the second holding component is the other of the socket or the stud.

Clause 37. The wearable article of clause 33, wherein the holding mechanism is a frictional fit mechanism, the first holding component is one of a contoured surface or a detent that fits to the contoured surface, and the second holding component is the other of the contoured surface or the detent.

Clause 38. The wearable article of any of clauses 19-37, wherein the wearable article is an article of footwear and the body is a footwear upper.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A tension-retaining system for retaining tension in a tensioning cord of a wearable article, the tension-retaining system comprising:

a retainer including:

an anchor defining a notch; and a wedge having a tensioning cord coupling feature; wherein the wedge has an engagement portion that fits within the notch with the engagement portion disposed further in the notch than the tensioning cord coupling feature;

wherein:

the wedge defines a pull cord coupling feature;

the tensioning cord coupling feature is disposed between the engagement portion and the pull cord coupling feature;

the tensioning cord coupling feature is a tensioning cord passage extending through the wedge;

the pull cord coupling feature is a pull cord passage extending through the wedge;

the wedge has an inner wall, an outer wall, an upper surface between the inner wall and the outer wall, and a lower surface between the inner wall and the outer wall;

the inner wall is between the wearable article and the outer wall when the anchor is coupled to the wearable article and the wedge is in the notch;

the tensioning cord passage and the pull cord passage extend through the wedge from the upper surface to the lower surface; and a longitudinal center axis of the pull cord passage is a first distance from the inner wall, a longitudinal center axis of the tensioning cord passage is a second distance from the inner wall, and the second distance is greater than the first distance.

2. The tension-retaining system of claim 1, wherein:
the anchor has a base and an outer wall diverging outward from the base;
the outer wall of the anchor extends to an edge defining an outer extent of the notch;
the outer wall of the wedge defines a lip; and
the lip engages the edge of the outer wall of the anchor when the engagement portion of the wedge is in the notch.

3. The tension-retaining system of claim 1, wherein:
the anchor has a convex engagement surface in the notch, the convex engagement surface extending toward the engagement portion of the wedge, and the engagement portion of the wedge has a concave engagement surface that abuts the convex engagement surface of the anchor when the engagement portion of the wedge is in the notch; and/or
the anchor has a concave engagement surface in the notch, the concave engagement surface extending away from the engagement portion of the wedge, and the engagement portion of the wedge has a convex engagement surface that abuts the concave engagement surface of the anchor when the engagement portion of the wedge is in the notch.

4. The tension-retaining system of claim 1, further comprising:
a holding mechanism holding the wedge in the notch when the engagement portion of the wedge is fit within the notch, the holding mechanism including a first holding component disposed on the anchor and a second holding component disposed on the wedge and interfitting with the first holding component.

5. The tension-retaining system of claim 4, wherein the holding mechanism is a snap, the first holding component is one of a socket or a stud that snaps within the socket, and the second holding component is the other of the socket or the stud.

6. The tension-retaining system of claim 4, wherein the holding mechanism is a frictional fit mechanism, the first holding component is one of a contoured surface or a detent that fits to the contoured surface, and the second holding component is the other of the contoured surface or the detent.

7. A wearable article comprising:
a body at least partially defining an interior cavity;
a closure system for tightening the body around the interior cavity, the closure system comprising:
a tensioning cord having a proximal portion operatively secured to the body and having a distal portion; and
a tension-retaining system that retains tension in the tensioning cord when the distal portion is pulled away from the proximal portion, the tension-retaining system comprising:
a retainer including an anchor and a wedge;
wherein the anchor is coupled to the body and defines a notch opening away from the proximal portion of the tensioning cord;
wherein the wedge defines a tensioning cord coupling feature with the distal portion of the tensioning cord coupled to the wedge at the tensioning cord coupling feature;
wherein the wedge has an engagement portion that fits within the notch with the engagement portion disposed further in the notch than the tensioning cord coupling feature so that tension in the tensioning cord biases the engagement portion of the wedge into the notch;
wherein the wedge defines a pull cord coupling feature and the tensioning cord coupling feature is disposed between the engagement portion and the pull cord coupling feature; and
a pull cord coupled to the wedge at the pull cord coupling feature; and
the closure system further comprising:
a first hook-and-loop fastener component coupled to the pull cord;
a second hook-and-loop fastener component secured to a surface of the body with the anchor between the proximal portion of the tensioning cord and the second hook-and-loop fastener component; and
wherein the first hook-and-loop fastener component releasably engages with the second hook-and-loop fastener component.

8. The wearable article of claim 7, wherein:
the tensioning cord coupling feature is a tensioning cord passage extending through the wedge; and
the pull cord coupling feature is a pull cord passage extending through the wedge.

9. The wearable article of claim 8, wherein:
the wedge has an inner wall, an outer wall, an upper surface between the inner wall and the outer wall, and a lower surface between the inner wall and the outer wall;
the inner wall is between the body and the outer wall when the wedge is in the notch;
the tensioning cord passage and the pull cord passage extend through the wedge from the upper surface to the lower surface; and
a longitudinal center axis of the pull cord passage is a first distance from the inner wall, a longitudinal center axis of the tensioning cord passage is a second distance from the inner wall, and the second distance is greater than the first distance.

10. The wearable article of claim 7, wherein:
the anchor has a base coupled to the body of the wearable article and an outer wall diverging outward from the base;
the outer wall of the anchor extends to an edge defining an outer extent of the notch;
the wedge has an outer wall that defines a lip; and
the lip engages the edge of the outer wall of the anchor when the engagement portion of the wedge is in the notch.

11. The wearable article of claim 7, wherein:
the anchor has a convex engagement surface in the notch, the convex engagement surface extending toward the engagement portion of the wedge, and the engagement portion of the wedge has a concave engagement surface that abuts the convex engagement surface of the anchor when the engagement portion of the wedge is in the notch; and/or
the anchor has a concave engagement surface in the notch, the concave engagement surface extending away from the engagement portion of the wedge, and the engagement portion of the wedge has a convex engagement surface that abuts the concave engagement surface of the anchor when the engagement portion of the wedge is in the notch.

12. The wearable article of claim 7, further comprising:
a holding mechanism holding the wedge in the notch when the engagement portion of the wedge is fit within the notch, the holding mechanism including a first holding component disposed on the anchor and a second holding component disposed on the wedge and interfitting with the first holding component.

13. The wearable article of claim 12, wherein the holding mechanism is a snap, the first holding component is one of a socket or a stud that snaps within the socket, and the second holding component is the other of the socket or the stud.

14. The wearable article of claim 12, wherein the holding mechanism is a frictional fit mechanism, the first holding component is one of a contoured surface or a detent that fits to the contoured surface, and the second holding component is the other of the contoured surface or the detent.

15. The wearable article of claim 7, wherein the wearable article is an article of footwear and the body is a footwear upper.

16. A tension-retaining system for retaining tension in a tensioning cord of a wearable article, the tension-retaining system comprising:

a retainer including:

an anchor defining a notch; and a wedge having a tensioning cord coupling feature;

wherein:

the wedge has an engagement portion that fits within the notch with the engagement portion disposed further in the notch than the tensioning cord coupling feature;

the anchor has a base and an outer wall diverging outward from the base;

the outer wall of the anchor extends to an edge defining an outer extent of the notch;

the wedge has an outer wall that defines a lip; and the lip engages the edge of the outer wall of the anchor when the engagement portion of the wedge is in the notch, the lip extending outward of the notch at the outer wall.

17. The tension-retaining system of claim 16, wherein:

the engagement portion of the wedge has a convex engagement surface that is convex in a direction from an inner wall to the outer wall of the wedge, and is convex in a direction from an upper surface to a lower surface of the wedge such that the convex engagement surface has a peak;

the anchor has a concave engagement surface in the notch that is concave in a direction from the base of the anchor to the outer wall of the anchor, and is concave in a direction from an upper surface to a lower surface of the anchor; and the convex engagement surface of the wedge is in contact with the concave engagement surface of the anchor with the peak centered against the concave engagement surface of the anchor when the engagement portion of the wedge is in the notch.

18. The tension-retaining system of claim 16, wherein:

the tensioning cord coupling feature is a passage extending through the wedge from an upper surface of the wedge to a lower surface of the wedge;

the upper surface and the lower surface of the wedge converge with a rear wall of the wedge; and at least a portion of the tensioning cord coupling feature is further toward the rear wall than the lip.

19. The tension-retaining system of claim 16, further comprising:

a holding mechanism holding the wedge in the notch when the engagement portion of the wedge is fit within the notch, the holding mechanism including a first holding component disposed on the anchor and a second holding component disposed on the wedge and interfitting with the first holding component.

20. The tension-retaining system of claim 19, wherein the holding mechanism is a snap, the first holding component is one of a socket or a stud that snaps within the socket, and the second holding component is the other of the socket or the stud.

* * * * *